US007008045B2

(12) United States Patent
Nakao et al.

(10) Patent No.: US 7,008,045 B2
(45) Date of Patent: Mar. 7, 2006

(54) LIQUID DROP DISCHARGER, TEST CHIP PROCESSOR, PRINTER DEVICE, METHOD OF DISCHARGING LIQUID DROP AND PRINTING METHOD, METHOD OF PROCESSING TEST CHIP, METHOD OF PRODUCING ORGANIC ELECTROLUMINESCENT PANEL, METHOD OF FORMING CONDUCTIVE PATTERN, AND METHOD OF PRODUCING FIELD EMISSION DISPLAY

(75) Inventors: Isamu Nakao, Tokyo (JP); Tsutomu Ishimoto, Saitama (JP); Masaru Uryu, Chiba (JP); Yoshio Ohashi, Kanagawa (JP); Takao Kondo, Tokyo (JP); Motohiro Furuki, Tokyo (JP); Masanobu Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 309 days.

(21) Appl. No.: 10/706,084

(22) Filed: Nov. 13, 2003

(65) Prior Publication Data

US 2004/0155927 A1 Aug. 12, 2004

(30) Foreign Application Priority Data

Nov. 29, 2002 (JP) ..... 2002-347816

(51) Int. Cl.

| | |
|---|---|
| ***B41J 2/015*** | (2006.01) |
| ***B41J 2/06*** | (2006.01) |
| ***B05C 5/00*** | (2006.01) |
| ***B05D 1/02*** | (2006.01) |

(52) U.S. Cl. ..... 347/53

(58) Field of Classification Search ..... None
See application file for complete search history.

(56) References Cited

U.S. PATENT DOCUMENTS

| | | | | |
|---|---|---|---|---|
| 5,828,394 | A * | 10/1998 | Khuri-Yakub et al. | 347/72 |
| 6,127,198 | A * | 10/2000 | Coleman et al. | 438/21 |
| 6,350,015 | B1 | 2/2002 | Gooray et al. | |

FOREIGN PATENT DOCUMENTS

| | | |
|---|---|---|
| EP | 0 887 185 | 12/1998 |
| EP | 0 888 888 | 1/1999 |
| WO | WO 99/03680 | 1/1999 |

OTHER PUBLICATIONS

Patent Abstracts of Japan, JP 2001-270104, Oct. 2, 2001.

* cited by examiner

*Primary Examiner*—Huan Tran
(74) *Attorney, Agent, or Firm*—Oblon, Spivak, McClelland, Maier & Neustadt, P.C.

(57) ABSTRACT

A liquid drop discharger includes a coil for generating a magnetic field based on an electric current that is applied; a moving section, removably disposed with respect to the coil so as to be movable in a central axial direction of the coil, for generating an induced current by the magnetic field generated by the coil; device for vertically applying a magnetic field to a peripheral surface of a peripheral member, where the induced current is generated, of the moving section; and a discharge opening, which moves together with the moving section, for discharging a liquid by changing the volume of a liquid chamber containing the liquid as a result of the movement of the moving section.

27 Claims, 15 Drawing Sheets

1

LIQUID DROP DISCHARGER, TEST CHIP PROCESSOR, PRINTER DEVICE, METHOD OF DISCHARGING LIQUID DROP AND PRINTING METHOD, METHOD OF PROCESSING TEST CHIP, METHOD OF PRODUCING ORGANIC ELECTROLUMINESCENT PANEL, METHOD OF FORMING CONDUCTIVE PATTERN, AND METHOD OF PRODUCING FIELD EMISSION DISPLAY

BACKGROUND OF THE INVENTION

1. Field of the Invention

The present invention relates to a liquid drop discharger and a method of discharging a liquid drop, a test chip processor and a method of processing a test chip using the liquid drop discharger, a printer device, a printing method, a method of producing an organic electroluminescent panel, a method of forming a conductive pattern, and a method of producing a field emission display.

2. Description of the Related Art

A liquid drop discharger, typified by an inkjet head of, for example, a printer, discharges liquid drops from a predetermined discharge opening by subjecting a liquid chamber containing a liquid, such as ink, to some sort of pressure. Various means for subjecting the liquid chamber to pressure have been proposed. For example, means having a structure using a piezoelectric device (piezo type) and means having a structure making use of a film-boiling phenomenon caused by a heat-generating device (bubble type) are widely used as liquid drop dischargers. In addition, means for discharging a liquid by moving a wall (film) of a liquid chamber by an electromagnetic force by a very small amount has been proposed (refer to, for example, Japanese Unexamined Patent Application Publication No. 2001-270104 (Patent Document 1)).

Such liquid drop dischargers are capable of discharging drops of a desired liquid onto predetermined locations precisely. Therefore, they are used not only when using a printer device, but also, for example, when disposing a liquid containing DNA onto each location of a chip in producing desoxyribonucleic acid (DNA) chip or in analyzing DNA, or when disposing a fluorescent material or a light-emitting material onto each pixel location during manufacturing of a display. Accordingly, they are beginning to be used in a wide range of applications. This has caused a demand for a more desirable liquid drop discharger that is used in such various applications including its use in a printer device.

A piezo liquid drop discharger such as that mentioned above is small and highly reliable, but has a high drive voltage. This demerit is overcome by a method of reducing an applied voltage itself by forming piezoelectric devices and electrodes in multiple layers. However, this method requires a high voltage of approximately 30 V and gives rise to another demerit that costs of the discharger are increased.

A liquid drop discharger of a type that uses a magnet in a drive circuit (such as the type disclosed in, for example, Patent Document 1 in which the wall of a liquid chamber is moved by electromagnetic force) has poor responsiveness due to an increase in inductance when the operating frequency is increased.

There is a demand that both types of liquid drop dischargers discharge liquid drops in accordance with a high-frequency drive signal, that is, to discharge individual liquids at a high speed.

When the bubble liquid drop discharger tries to discharge a liquid containing an organic material, such as DNA or protein, the organic material is decomposed as a result of being exposed to high temperature and pressure, so that the discharger cannot properly discharge the material to be discharged.

When handling such an organic material, it is necessary to frequently clean and replace a nozzle, such as a discharge opening, a liquid chamber, and a liquid supply path. However, since, in the piezo liquid drop discharger, a piezoelectric device is connected directly to a diaphragm or is connected to the diaphragm by a fine mounting technology, it is difficult to separate the piezoelectric device and replace the nozzle. The piezoelectric device and the nozzle may be constructed so that they can be replaced together, but the portions to be replaced are expensive and re-connection of an electrical wiring is required. Therefore, this structure is not a practical structure.

SUMMARY OF THE INVENTION

Accordingly, it is an object of the present invention to make it possible to easily replace and clean a nozzle without exposing a liquid to high temperature and high pressure. It is another object of the present invention to provide various devices and production methods which make it possible to produce and manufacture a desired product efficiently so that it is of high quality as a result of discharging desired liquid drops at a high speed and with high precision by using a liquid drop discharger or a method of discharging a liquid drop. The device can be driven at a low voltage and a high frequency, and the method allows driving at a low voltage and a high frequency. More specifically, it is another object of the present invention to provide a printer device and a printing method, a test chip processor and a method of processing a test chip, a method of producing an organic electroluminescent panel, a method of forming a conductive pattern, and a method of producing a field emission display.

To these ends, according to the present invention, there is provided a liquid drop discharger comprising a coil for generating a magnetic field based on an electric current that is applied; a moving section, removably disposed with respect to the coil so as to be movable in a central axial direction of the coil, for generating an induced current by the magnetic field generated by the coil; means for vertically applying a magnetic field to a peripheral surface of a peripheral member, where the induced current is generated, of the moving section; and a discharge opening, which moves together with the moving section, for discharging a liquid by changing the volume of a liquid chamber containing the liquid to be discharged as a result of the movement of the moving section.

In the liquid drop discharger having such a structure, by a change in the magnetic field that is generated by a fixed primary coil (the coil), induced current is generated at the peripheral member, which is a secondary coil, of the moving section. The induced current and a static magnetic field, which is previously applied by the magnetic field applying means, interact with each other, thereby moving the peripheral member, that is, the moving section.

When the moving section moves, the volume of the liquid chamber (which is formed so that, for example, one portion thereof moves together with the moving section and changes its shape, and which contains liquid that is discharged) is changed. By this, the liquid in the liquid chamber is discharged from the discharge opening.

In the present invention, the liquid can be discharged without heating the liquid with a heat-generating device. In addition, since it is not necessary to mount a piezoelectric device, etc., to the moving section, the moving section is easily replaced and cleaned.

DESCRIPTION OF THE PREFERRED EMBODIMENTS

A description of a first embodiment of the present invention will be given with reference to FIGS. 1 to 11.

Embodiments are applied to a liquid drop discharger of the present invention applied to various devices, such as a DNA disc player or a printer device, and to a method of producing these devices. A basic structure of the liquid drop discharger of the present invention will be described in detail by giving specific structural examples.

First, the structure of the liquid drop discharger of the embodiment will be described.

Figure 1:
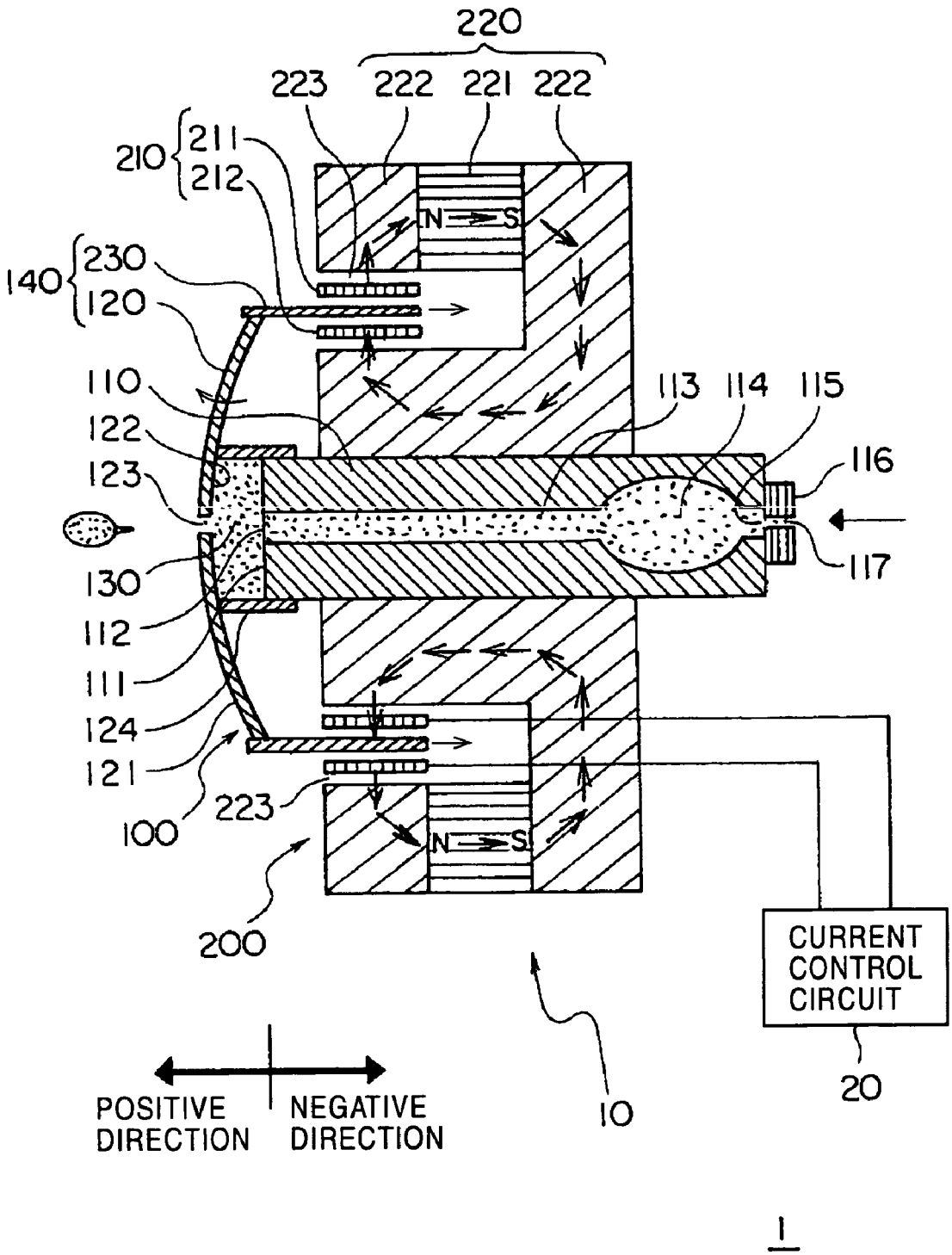
FIG. 1 illustrates a basic structure of a liquid drop discharge head of a first embodiment of the present invention.

FIG. 1 shows the structure of a liquid drop discharger 1.

The liquid drop discharger 1 comprises a liquid drop discharge head 10 and a current control circuit 20. The liquid drop discharge head 10 comprises a nozzle 100 and a drive section 200. The nozzle 100 comprises a liquid chamber securing section 110 (flow path) and a liquid discharge section 120.

The liquid discharge section 120 and a cylindrical conductive member (peripheral member) 230 (described later) of the drive section 200 are integrally formed. The liquid discharge section 120 and the cylindrical conductive member 230 form a moving section 140.

A liquid chamber 130 for containing a liquid to be discharged is formed between the liquid discharge section 120 of the moving section 140 and the liquid chamber securing section 110.

Hereunder, the structure of each part will be described in detail.

The liquid chamber securing section 110 of the nozzle 100 of the liquid drop discharge head 10 is integrally disposed with the drive section 200 by being secured to a housing of the liquid drop discharge head 10 or a base (not shown). At one end surface 111, the liquid chamber securing section 110 is a cylindrical member defining the back surface of the liquid chamber 130.

A liquid supply path 113 for supplying liquid (to be discharged) to the liquid chamber 130 is formed in the liquid chamber securing section 110. The liquid supply path 113 passes through the liquid chamber securing section 110 from a liquid supplying opening 112, which is formed in the end surface 111, to an opening 115, which is formed in the other end of the liquid chamber securing section 110.

A liquid reservoir 11, which, as shown in FIG. 1, is formed by increasing the diameter of the liquid supplying path 113, is disposed at a predetermined section near the opening 115 of the liquid supplying path 113. The supplied liquid is temporarily held in the liquid reservoir 114.

A cover 116 having an air removing hole 117 communicating with the liquid supplying path 113 is disposed on the opening 115 at the other end of the liquid chamber securing section 110.

In the liquid drop discharge head 10 in the embodiment, the inner diameter of the liquid chamber 130 is approximately 2.5 mm, and the outer diameter of the liquid chamber securing section 110 is slightly smaller than that (for example, less than 2.5 mm by 20 $\mu$m). The inner diameter of the liquid supplying path 113 is 50 $\mu$m. However, in the present invention, the diameters are not limited to these values.

The liquid discharge section 120 is installed consecutively with the liquid chamber securing section 110, so that the liquid chamber 130 is formed. The liquid discharge section 120 is a member for discharging the liquid in the liquid chamber by moving together with the cylindrical conductive member 230 and changing the volume of the liquid chamber 130.

The liquid discharge section 120 comprises a front plate 121 and a guide 124.

As shown in FIG. 1, the front plate 121 is a dome-shaped member with a slightly bulging central portion. A region that is disposed near the central portion of the front plate 121 and surrounded by the guide 124 (described later) defines a surface 122 defining the front surface of the liquid chamber 130. A discharge opening 123 for discharging liquid is formed in the central portion of the front plate 121. The cylindrical conductive member 230 of the drive section 200 (described later) is integrally formed with a peripheral edge of the front plate 121. In the embodiment, the thickness of the front plate 121 is approximately 20 μm.

The guide 124 is a cylindrical member. It defines the side surface of the liquid chamber 130, has an inner diameter that is substantially equal to the outer diameter of the liquid chamber securing section 110 so that the guide 124 guides the movement of the moving section 140 (described later) including the liquid drop discharge section 120, and slidably contacts the outer periphery of the securing section 110 so as to be movable in the axial direction.

One end of the guide 124 is joined near the central portion of the inner side of the front plate 121, and the side surface of the liquid chamber 130 is defined by the guide 124 itself.

The guide 124 is mounted to the liquid chamber securing section 110 so that the liquid chamber securing section 110 is inserted in and fitted to the inner side of the guide 124. Hereinafter, such a state will be called a fittingly mounted state. By this, the liquid chamber 130, defined by the end surface 111 of the liquid chamber securing section 110, the inner surface of the guide 124, and the inner surface 122 of the front plate 121, is formed.

In the embodiment, the inner diameter of the guide 124 and the inner diameter of the liquid chamber 130 are 2.5 mm.

The liquid chamber securing section 110 is formed so that its outer diameter is slightly smaller than the inner diameter of the guide 124. Therefore, the guide 124 is fittingly mounted to the liquid chamber securing section 110 so as to be slidable in the axial direction.

Ordinarily, the guide 124 is fittingly mounted to the liquid chamber securing section 110 up to a predetermined reference position where the volume of the liquid chamber 130 is a predetermined size. However, when a liquid drop is discharged, the guide 124 slides from the reference position in a direction in which the volume of the liquid chamber 130 increases (leftwards in FIG. 1, and hereinafter referred to as a "positive direction") or in a direction in which the volume of the liquid chamber 130 decreases (rightwards in FIG. 1, and hereinafter referred to as a "negative direction"), causing the front surface 122 to move, thereby changing the volume of the liquid chamber 130.

In the embodiment, with the position of the guide 124 when the axial length of the liquid chamber 130 is approximately 1 mm being the reference position, when a liquid drop is discharged, the guide 124 moves approximately 15 μm in the positive or negative direction.

A lubricant coating may be applied to the inner surface of the guide 124 or the outer surface of the liquid chamber securing section 110 in order to increase slidability.

The liquid chamber 130 is defined by the end surface 111 of the liquid chamber securing section 110, the front surface 122 of the front plate 121 of the liquid discharge section 120, and the guide 124. The inner diameter of the liquid chamber 130 is 2.5 mm, and its usual axial length is approximately 1 mm. The inner portion of the liquid chamber 130 is subjected to surface treatment with, for example, a metal oxide so that it is hydrophilic. By this, a polar solution is easily introduced into the liquid chamber 130.

By moving the cylindrical conductive member 230 of the drive section 200 (described later) in the axial direction, the front plate 121 (front surface 122) of the liquid discharge section 120 and the guide 124, which are integrally formed with the conductive member 230, also move, thereby changing the volume of the liquid chamber 130. As a result, the liquid in the liquid chamber 130 is discharged from the discharge opening 123.

The range of movement of the cylindrical conductive member 230, the front surface 122, and the guide 124 is approximately ±15 μm from the reference position.

Figure 2:
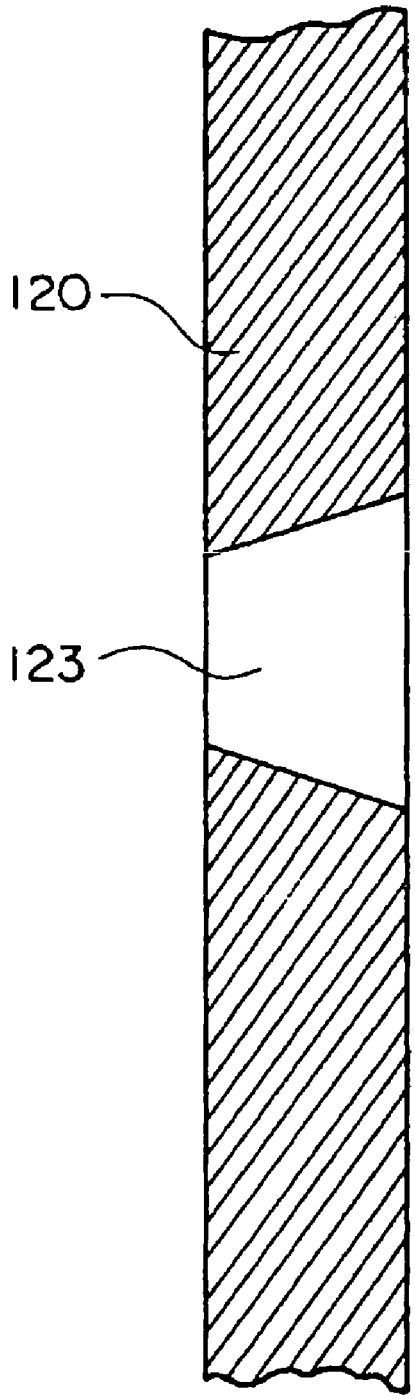
FIG. 2 illustrates the structure of a discharge opening of the liquid drop discharge head of the first embodiment of the present invention.

As shown in FIG. 2, the discharge opening 123 of the front surface 122 (front plate 121) is formed with a tapered shape so that its diameter becomes gradually smaller from the inner side of the liquid chamber 130 (the liquid chamber securing section 110 side of the front plate 121) towards the outer side of the liquid chamber 130 (side towards which liquid is discharged). In other words, the discharge opening 123 is conical in cross section. In the embodiment, the diameter of the discharge opening 123 at the inner side and outer side (liquid discharge side) of the liquid chamber 130 are 30 μm and 20 μm, respectively. The thickness of the discharge opening 123 is 20 μm. A wall surface defining the discharge opening 123 that is disposed near the location where a liquid surface contacts the atmosphere is subjected to surface treatment with a compound, such as a silane compound or a Teflon compound (Teflon is a registered trademark of E.I. Dupont de Neumours, Inc.), so that it is hydrophobic. By this, the liquid tends to separate from the wall surface when the liquid is discharged.

As shown in FIG. 1, the drive section 200 comprises a primary coil 210 and an annular magnetic circuit 220. The annular magnetic circuit 220 having a gap 223, which is substantially concentrically disposed at the outer side of the liquid chamber securing section 110, is disposed, with the primary coil 210 and the cylindrical conductive member 230 being disposed at the gap 223.

In order to generate an induced current at the cylindrical conductive member 230, which forms a secondary coil disposed along the primary coil 210, the primary coil 210 generates a magnetic field based on an electrical current applied from the current control circuit 20. The magnetic field acts upon the cylindrical conductive member 230.

The primary coil 210 comprises an outer primary coil 211 and an inner primary coil 212, which are concentrically wound one above the other in the same direction so that the direction of electrical current flowing through them is the same. The central axis of the two concentric coils are substantially aligned with the central axis of the liquid chamber securing section 110 of the nozzle 100. As shown in FIG. 1, in order for the two concentric coils to be disposed in the gap 223 at the annular magnetic circuit 220, disposed around the periphery of the liquid chamber securing section 110, the two concentric coils, like the liquid chamber securing section 110, are disposed by being secured to the housing or base (not shown) of the head 10.

Figure 5:
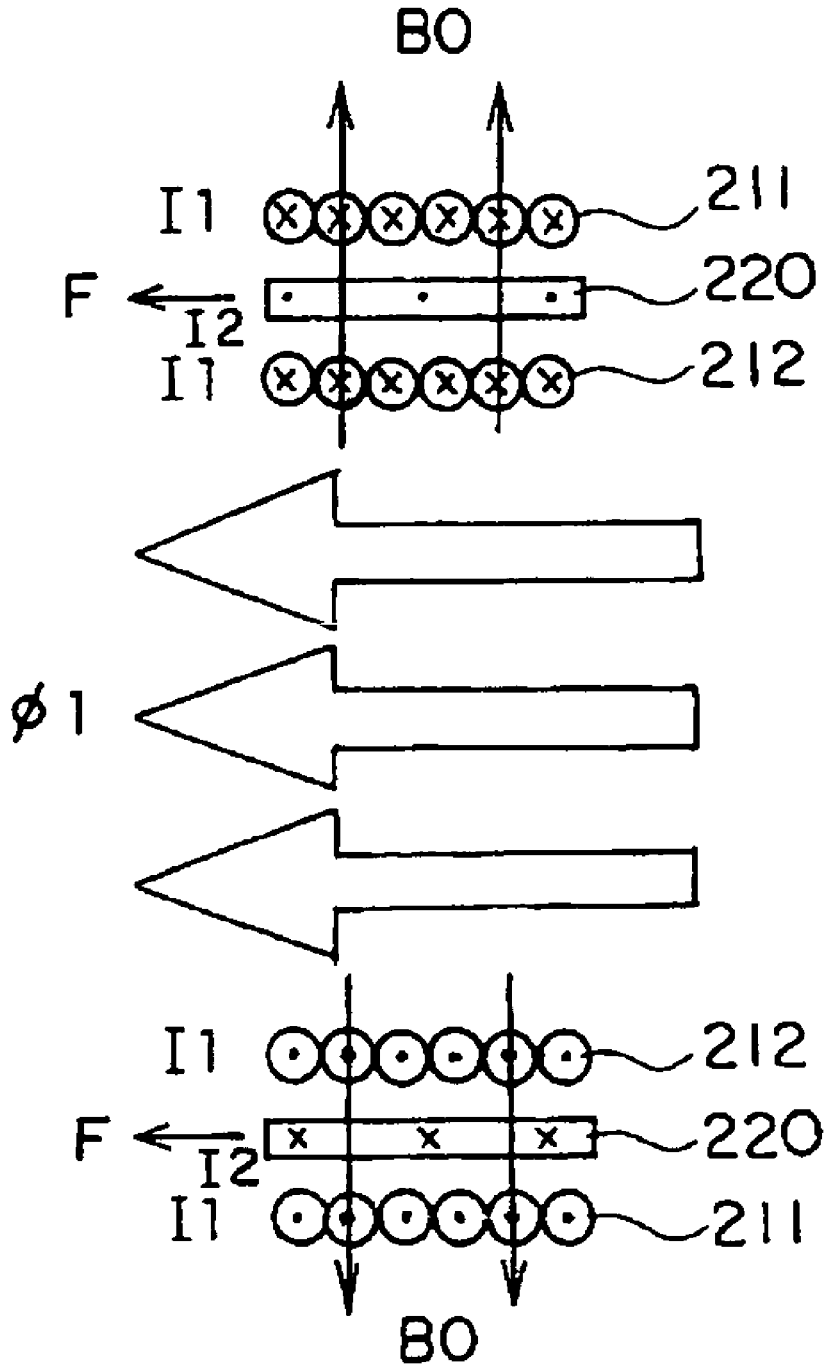
FIG. 5 illustrates the action of the magnetic field that is generated by the primary coil and the magnetic field that is generated by the annular magnetic circuit upon the conductive ring serving as a secondary coil in the drive section of the liquid drop discharge head of the first embodiment of the present invention.

The cylindrical conductive member 230, which is a secondary coil, is disposed between the outer primary coil 211 and the inner primary coil 212. As shown in FIG. 5, magnetic flux that is generated by the primary coil 210 is such as to pass through the inner side of the cylindrical conductive member 230. When, using the current control circuit 20, an unsteady current flows through the primary coil 210 having such a structure, a magnetic flux $\phi$, which is generated in a space defined by the primary coil 210 and the cylindrical conductive member 230, changes, so that an induced current is generated at the cylindrical conductive member 230.

The annular magnetic circuit 220, shown in FIG. 1, applies a static magnetic field to the cylindrical conductive member 230, with the static magnetic field being perpendicular to a peripheral surface of the cylindrical conductive member 230.

The annular magnetic circuit 220 comprises a permanent annular magnet 221 and a soft magnetic member 222, which holds the permanent magnet 221 and forms the annular gap 223. The gap 223 is such that a radial static magnetic field is formed. Like the liquid chamber securing section 110, the annular magnetic circuit 220 is disposed by being secured to the housing or the base (not shown) of the head 10 so as to be situated on both sides of the cylindrical conductive member 230 through the gap 223, that is, so that a coil section, including the outer primary coil 211, the cylindrical conductive member 230, and the inner primary coil 212, which are concentrically disposed, is disposed in the gap 223.

By virtue of such a structure, the annular magnetic circuit 220 applies a static magnetic field to the primary coil 210 and the cylindrical conductive member 230, which are disposed in the gap 223, with the static magnetic field being perpendicular to peripheral surfaces of the primary coil 210 and the cylindrical conductive member 230.

The annular magnetic circuit 220 may comprise a plurality of magnetic circuits that are intermittently disposed and formed around the cylindrical conductive member 230, or it may be an integrally formed annular member which, like the cylindrical conductive member 230, surrounds the liquid chamber securing section 110.

In the embodiment, the permanent magnet 221 of the annular magnetic circuit 220 may be formed of, for example, neodymium, iron, or boron. The soft magnetic member 222 may be formed of, example, iron, a permalloy, or ferrite.

The cylindrical conductive member (peripheral member) 230 is a secondary coil disposed along the first coil 210. A change in the magnetic flux $\phi$, which is generated by the primary coil 210, generates an induced current at the secondary coil. Interaction between the induced current and the static magnetic field applied by the annular magnetic circuit 220 generates an electromagnetic force. By the action of the electromagnetic force, the secondary coil functions as a voice coil, and moves in a central axial direction, causing the liquid discharge section 120 of the nozzle 100, which is integrally formed with the secondary coil, to move. The cylindrical conductive member 230 is a cylindrical (annular) conductive member formed of a paramagnetic material, such as aluminum.

The cylindrical conductive member 230 is integrally formed with the peripheral edge of the front plate 121 of the liquid discharge section 120 of the nozzle 100, and forms the moving section 140 along with the liquid discharge section 120. By fittingly mounting the guide 124 to the liquid chamber securing section 110, the movement of the moving section 140 in the radial direction of the cylindrical conductive member 230 is restricted. In contrast, the moving section 140 is disposed with respect to a stationary portion of the nozzle 100 so as to be movable in a central axial direction of the cylindrical conductive member 230.

As shown in FIG. 5, the cylindrical conductive member 230 is disposed concentrically with and apart from the primary coil 210. The magnetic flux $\phi$, which is generated by the primary coil 210, passes substantially unchanged through the space defined by the inner sides of the cylindrical conductive member 230. Therefore, when the magnetic flux $\phi$; which is generated at the primary coil 210, changes, an induced electromotive force is generated at the cylindrical conductive member 230, so that an induced current is generated around the cylindrical conductive member 230.

An induced electromotive force E, which is generated at the cylindrical conductive member 230, is expressed by Formula 1, based on Faraday's law of electromagnetic induction. In Formula 1, the left side represents an induced electromotive force as a line integral in the direction along the peripheral surface of the cylindrical conductive member 230 when the peripheral surface of the cylindrical conductive member 230 is viewed as a closed curve C, and the right side represents a change with time in the magnetic flux resulting from integrating an area over any curved surface S surrounded by the cylindrical conductive member 230, and shows a change in the magnetic flux passing through the space defined by the inner sides of the cylindrical conductive member 230.

Here, current flows through the cylindrical conductive member 230 in a direction in which changes in magnetic flux are cancelled, that is, in a direction in which a change in current is the reverse of a change in current in the primary coil 210.

Formula 1

$$\int_C E(\vec{x}, t) \cdot dx = -\int_S \frac{\partial B(\vec{x}, t)}{\partial t} \cdot \vec{n}(\vec{x}) dS \tag{1}$$

A static magnetic field is always applied to the cylindrical conductive member 230 in a direction that is perpendicular to the peripheral surface of the cylindrical conductive member 230. In the embodiment, as shown in, for example, FIG. 4, a magnetic field that is directed from the inner side to the outer side of the cylindrical conductive member 230 is applied.

As a result, an Ampere electromagnetic force, which is generated by the interaction between the static magnetic field applied by the magnetic circuit 220 and the induced current based on a change in the magnetic flux $\phi 1$ that is generated by the primary coil 210, acts upon the cylindrical conductive member 230, so that the cylindrical conductive member 230 operates as a voice coil, causing the moving section 140, which is integrally formed with the cylindrical conductive member 230, including the liquid discharge section 120 to move.

The electromagnetic force is determined by Formula 2. The direction of the electromagnetic force corresponds to the direction of the vector product of an induced current I and a magnetic field B, that is, to the central axial direction of the cylindrical conductive member 230

Formula 2

$$\Delta \vec{F}(\vec{s}) = I \Delta \vec{s} \times \vec{B}(\vec{s}) \tag{2}$$

Based on a control signal from, for example, a host controller (not shown), the current control circuit 20 causes a desired current to flow through the primary coil 210 of the drive section 200 so that a liquid drop is discharged from the discharge opening 123 by moving the moving section 140 as a result of moving the cylindrical conductive member 230.

As mentioned above, by causing an unsteady current to flow through the primary coil 210, magnetic flux passing through a coil surface of the cylindrical conductive member 230 changes, causing an induced current to be produced at the cylindrical conductive member 230, so that, by the interaction between the induced current and the static magnetic field applied by the magnetic circuit 220, the cylindrical conductive member 230 is moved. At this time, the direction of movement of the cylindrical conductive member 230 changes in accordance with the direction of the current flowing through the primary coil 210. The speed of its movement (size of the force exerted upon the cylindrical conductive member 230) changes in accordance with the amount of change of the current flowing through the primary coil 210.

The current control circuit 20 controls the current applied to the primary coil 210 so that a liquid drop is discharged in a desired state from the discharge opening 123 as a result of moving the moving section 140, that is, the cylindrical conductive member 230 in a desired direction and with a desired speed (force) by a desired amount.

Next, the operation of the liquid drop discharger 1 having such a structure will be described with reference to FIGS. 3 to 7.

Figure 3:
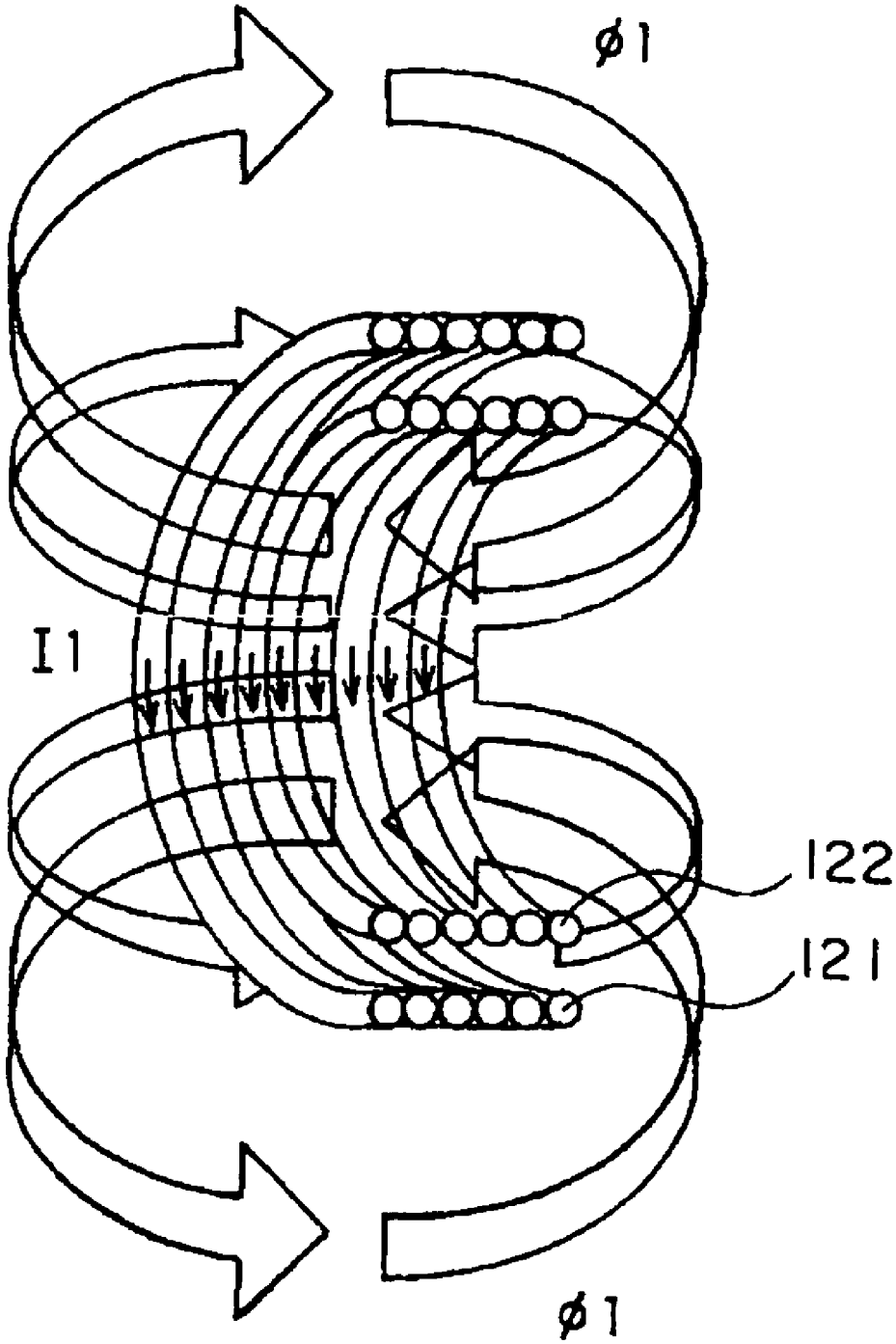
FIG. 3 illustrates a magnetic field which is generated by a primary coil in a drive section of the liquid drop discharge head of the first embodiment of the present invention.

First, when the current control circuit 20 causes a current 11, illustrated in FIG. 3, to flow through the primary coil 210, the magnetic flux $\phi$1 is generated around the primary coil 210, as shown in FIG. 3. At this time, the magnetic flux passing within a plane surrounded by the primary coil 210 passes unchanged through the space defined by the cylindrical conductive member 230.

In such a structure, when the current applied to the primary coil 210 by the current control circuit 20 changes, the magnetic flux $\phi$1, which is generated by the primary coil 210, also changes. As a result, the magnetic flux passing through the cylindrical conductive member 230 also changes.

Figure 4:
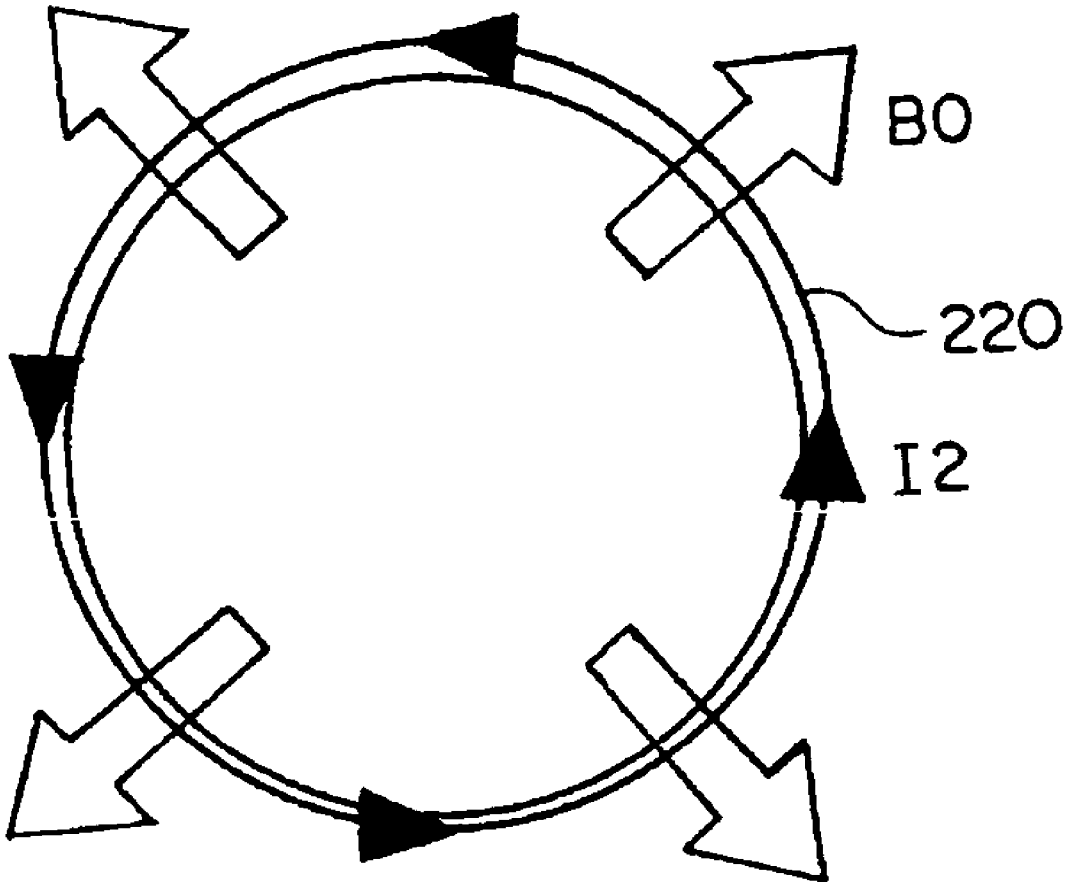
FIG. 4 illustrates an induced current which is generated at a conductive ring by the action of the primary coil and an annular magnetic circuit in the drive section of the liquid drop discharge head of the first embodiment of the present invention.

When a change occurs in the magnetic flux passing within the plane surrounded by the cylindrical conductive member 230, an induced electromotive force, which is based on Faraday's law of electromagnetic induction, such as Formula 1, is generated at the cylindrical conductive member 230, so that, for example, an induced current I2, shown in FIG. 4, is generated along the peripheral surface of the cylindrical conductive member 230.

By the action of the magnetic circuit 220, a static magnetic field B0, which is oriented in a direction perpendicular to the peripheral surface of the cylindrical conductive member 230, that is from the inner side to the outer side of the peripheral surface in the embodiment as shown in FIG. 4, is applied to the cylindrical conductive member 230. As a result, as shown in FIG. 5, an electromagnetic force F, which is generated by the interaction between the induced current I (I2) and the static magnetic field B (B0) based on Formula 2, acts upon the cylindrical conductive member 230.

By this, the cylindrical conductive member 230 moves in a positive or a negative central axial direction (direction of a liquid discharge surface in the state shown in FIG. 5) in accordance with the current applied to the primary coil 210.

In a basic operation of the cylindrical conductive member 230, the cylindrical conductive member 230 is first disposed at a predetermined reference position in its initial state, and reciprocates in the axial direction when discharging liquid. The current control circuit 20 applies an electric current in a predetermined sequence so that the cylindrical conductive member 230 moves in such a fashion. At this time, the distance of movement of the cylindrical conductive member 230 is on the order of 15 $\mu$m.

When the cylindrical conductive member 230 moves in the central axial direction, the liquid discharge section 120, which is joined to the cylindrical conductive member 230 as the moving section 140, also moves together with the cylindrical conductive member 230, thereby moving the front surface 122 and the guide 124 defining the liquid chamber 130. In other words, the movement of the cylindrical conductive member 230 causes the front surface 122 to approach or move away from the back surface 111, thereby reducing or increasing the volume of the liquid chamber 130, respectively.

In an actual operation for discharging a liquid, like the cylindrical conductive member 230, the front surface 122 reciprocates to an expansion position that is situated 15 $\mu$m from a reference position at the expansion side of the liquid chamber 130 or to a contraction position that is situated 15 $\mu$m from the reference position at the contraction side of the liquid chamber 130. A predetermined position at which the axial length of the liquid chamber 130 is 1 mm is defined as the reference position.

The liquid chamber 130 is filled with a liquid to be discharged from the liquid reservoir 114 and the liquid supplying path 113 of the liquid chamber securing section 110. At this time, the liquid supplying path 113 supplies liquid as required to the nozzle 100, that is, to the liquid chamber 130 in accordance with a suction force that is generated at the nozzle 100 by the movement of the front surface 122.

When, with the liquid chamber 130 being filled with the liquid, as mentioned above, the front surface 122 reciprocates in the axial direction between the reference position and the expansion position and between the reference position and the contraction position, the liquid in the liquid chamber 130 can be discharged from the discharge opening 123.

A description of a state in which a liquid drop is discharged from the discharge opening 123 will be given with reference to FIGS. 6 and 7.

Figure 6A:
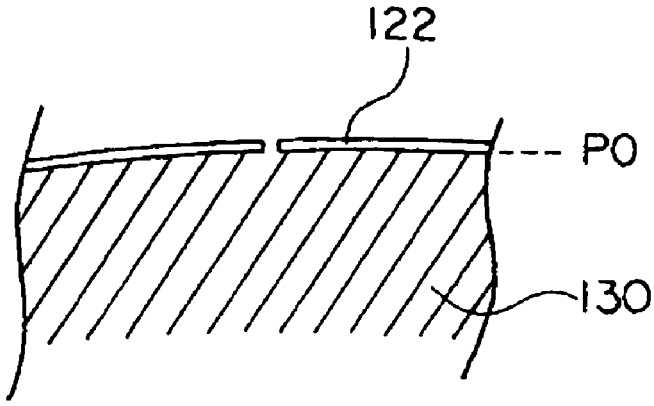
FIGS. 6A, 6B, and 6C illustrate a process of discharging a liquid drop by vibration of a movable section in the direction of contraction in the liquid drop discharge head of the first embodiment of the present invention.
Figure 6B:
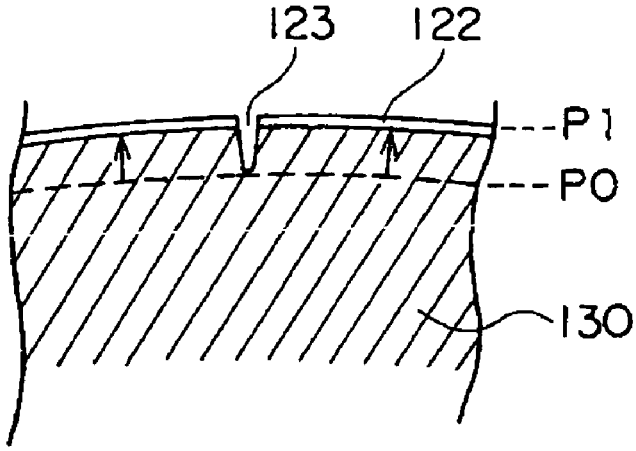

First, a description of a state in which a liquid drop is discharged by reciprocation of the discharge opening 123 between the reference position and the expansion position will be given with reference to FIGS. 6A, 6B, and 6C.

The front surface 122 moves from an initial position (refer to FIG. 6A) at which the front surface 122 is at a reference position P0 and the liquid chamber 130 is filled to capacity with a liquid to an expansion position P1 (refer to FIG. 6B) that is separated by 15 $\mu$m from the reference position P0 in the direction in which the front surface 122 causes the liquid chamber 130 to expand. Since the movement is rapid, as shown in FIG. 6B, a gap having no liquid in it is formed in a portion of the inside of the liquid chamber 130 near the discharge opening 123.

Figure 6C:
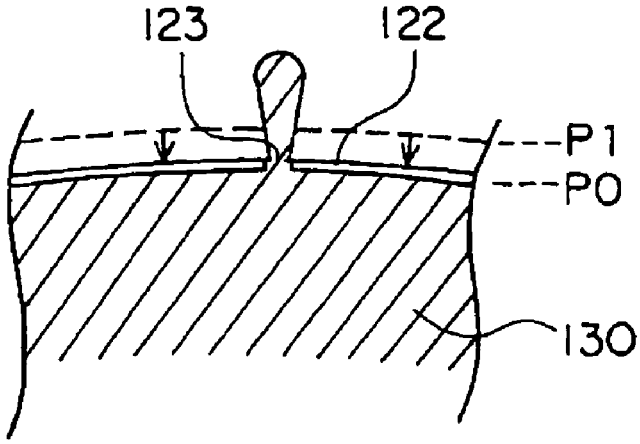

Thereafter, as shown in FIG. 6C, the front surface 122 returns rapidly to the reference position P0, so that a liquid drop is discharged from the discharge opening 123.

It is desirable to adjust the speed of movement of the front surface 122 in accordance with parameters, such as the viscosity (resonant frequency) of the liquid.

Figure 7A:
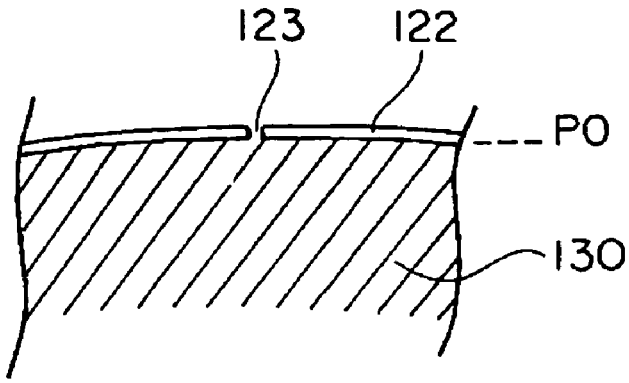
FIGS. 7A, 7B, and 7C illustrate a process of discharging a liquid drop by vibration of the movable section in the direct on of expansion in the liquid drop discharge head of the first embodiment of the present invention.
Figure 7B:
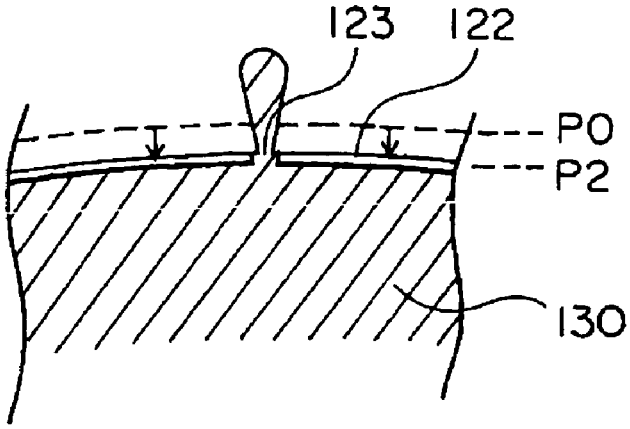
Figure 7C:
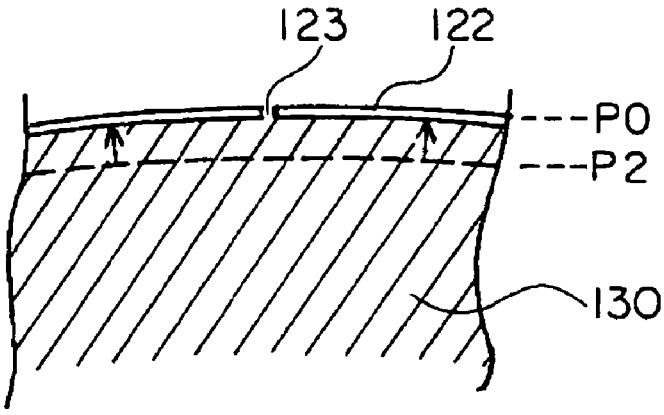

Next, a state in which a liquid drop is discharged by reciprocation of the discharge opening 123 between the reference position and the contraction position will be described with reference to FIGS. 7A, 7B, and 7C.

The front surface 122 moves from the initial position (refer to FIG. 7A) at which the front surface 122 is at the reference position P0 and the liquid chamber 130 is filled to capacity with a liquid to a contraction position P2 (refer to FIG. 7B) that is separated by 15 $\mu$m from the reference position P0 in the direction in which the front surface 122 causes the liquid chamber 130 to contract. In this case if the kinetic energy of the liquid that is pushed out from the discharge opening 123 is greater than the surface tension at the discharge opening 123, as shown in FIG. 7B, a drop of the liquid is discharged from the discharge opening 123.

When the front surface 122 in this state moves so as to return to the original reference position P0, the liquid chamber 130 is subjected to a negative pressure, that is, a suction force, so that an additional amount of liquid is sucked in from an external liquid supplying section through the liquid supplying path 113. After passage of a predetermined amount of time, as shown in FIG. 7C, the liquid chamber 130 is filled to capacity with liquid again.

Such operations are repeated in order to discharge liquid drops from the nozzle 100 at a desired timing.

Next, the maintenance of the liquid drop discharger 1 will be described. For example, when one wants to change the liquid to be discharged, or to replace the liquid discharge section 120, or to clean members for handling the liquid, such as the liquid chamber 130, the moving section 140 of the liquid drop discharger 1 is removed from the liquid chamber securing section 110 and the drive section 200.

As described above, in the nozzle 100 of the liquid drop discharger 1, while the liquid chamber securing section 110 and the drive section 200 are secured to the base or the housing, the moving section 140 comprising the liquid discharge section 120 and the cylindrical conductive member 230 is disposed only by fittingly mounting the guide 124 to the liquid chamber securing section 110, so that the moving section 140 is not fixed in any way.

In addition, the moving section 140 does not have, for example, an electrical wiring connected thereto, so that, when the guide 124 is dismounted from the liquid chamber securing section 110, the moving section 140 is separated as a separate solid body from the nozzle 100.

Therefore, when the liquid drop discharger 1 is to be maintained, the moving section 140 is separated in the aforementioned manner. With the moving section 140 being separated, for example, the moving section 140 and the liquid chamber securing section 110 can be cleaned, or the moving section 140 can be replaced.

After completing the maintenance, the nozzle 100 is restored to its original state by only inserting the liquid discharge section 120 of the moving section 140 into the liquid chamber securing section 110 again. By making the liquid chamber securing section 110 removable from drive section 200, the liquid drop discharger 1 is more easily maintained.

Accordingly, in the liquid drop discharger 1 of the embodiment, the cylindrical conductive member 230, which is joined to the front plate 121 of the moving section 140 for discharging a liquid drop, is moved by electromagnetic force resulting from interaction between the induced current, which is generated by the primary coil 210, and the static magnetic field, applied by the annular magnetic circuit 220, thereby discharging a liquid drop.

Therefore, the movable section 140 of the nozzle 100 is only held by fittingly mounting the liquid drop discharge section 120 to the liquid chamber securing section 110, so that a complicated securing structure and an electrical wiring are not used at all. Consequently, it is possible to easily mount and dismount the movable section 140 to and from the nozzle 100.

As a result, both the moving section 140 and the liquid chamber securing section 110 are easily cleaned, and the moving section 140 is easily replaced. In addition, since a structure for handling the liquid to be discharged is easily cleaned and replaced, it is possible to easily replace the liquid to be discharged.

Thus, the liquid drop discharger 1 may be desirably applied to a test device which tests, for example, DNA, ribonucleic acid (RNA), or protein, and which requires frequent replacement and cleaning of the nozzle.

In the liquid drop discharger 1 of the embodiment, the liquid in the liquid chamber 130 to be discharged does not need to be heated. Therefore, even if the liquid contains a substance that is decomposed or transformed by heat, the liquid drop discharger 1 of the embodiment may be used to discharge such a liquid. The liquid drop discharger 1 is capable of properly discharging a liquid containing a biological substance, such as DNA, RNA, or protein, a fluorescent material, or an organic material containing any of these substances or material, without affecting the organic material in any way.

The liquid drop discharger 1 can be operated at a low voltage. The operation is described with reference to FIG. 8.

Figure 8:
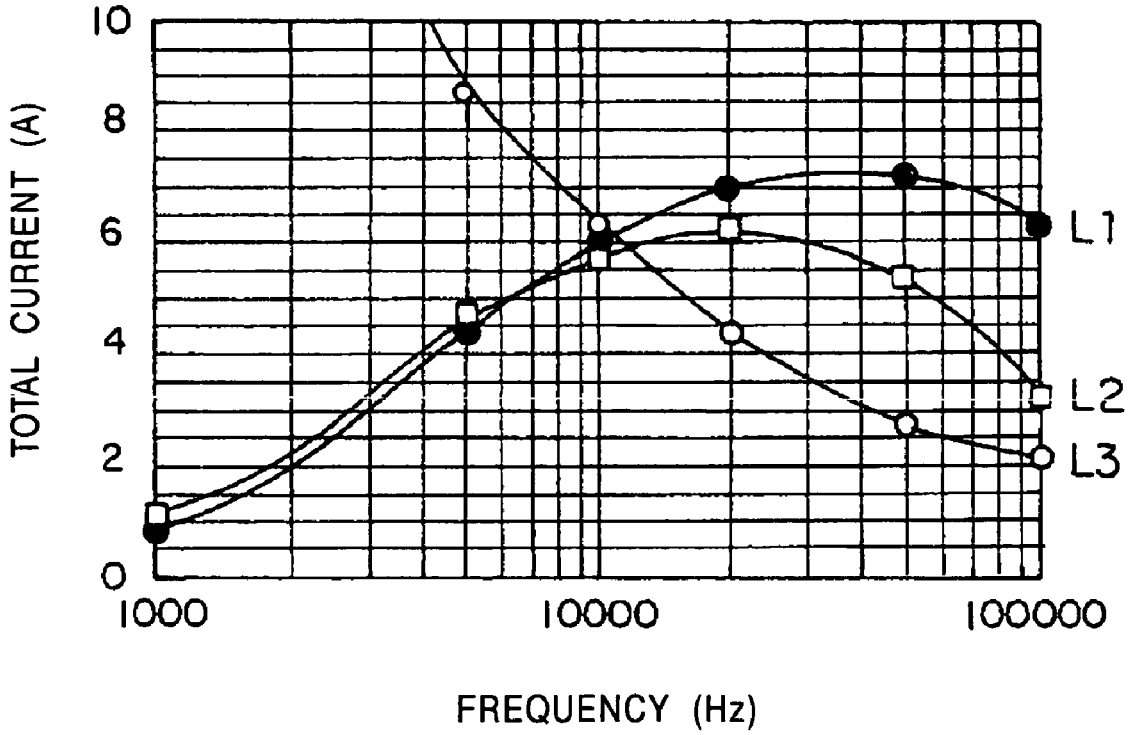
FIG. 8 is a graph showing frequency characteristics of the induced current that is generated at the conductive ring of the liquid drop discharge head of the first embodiment of the present invention.

FIG. 8 is a graph showing frequency characteristics resulting from analyzing a finite element model of a cross section of the magnetic circuit for the voice coil using a vector potential method. In FIG. 8, L1 denotes a frequency characteristic of a current flowing through the cylindrical conductive member 230 when the primary coil 210 and the cylindrical conductive member 230 of the liquid drop discharger 1 of the embodiment are used in combination; L2 denotes a frequency characteristic when the primary coil 210 has one coiled portion; and L3 denotes a frequency characteristic of a general voice coil.

More specifically, when the structure of the drive section 200 has the characteristic L1, in the primary coil 210, the outer primary coil 211 has a diameter of 18.1 mm, the inner primary coil 212 has a diameter of 16.3 mm, the number of windings of each is 15 (total: 30), the winding width of each is 2 mm, the direct current resistance of each is 2 Ω (total: 4 Ω), and the relative magnetic permeability of each is 6480; and the secondary coil has a diameter of 17.5 mm, the number of windings of the secondary coil is 1, its winding width is 2 mm, its direct current resistance is 0.0038 Ω, and its volume resistivity is 46 $\mu\Omega$cm.

When the drive section 200 has the characteristic L2, the outer primary coil 211 in the structure of the drive section 200 having the characteristic L1 is not provided, and the number of windings of the inner primary coil 212 is 30. In other words, its primary coil 210 is one coiled portion.

As shown in FIG. 8, in the voice coils of the structures of the drive section 200 of the embodiment having the respective characteristics L1 and L2 or of structures based on the structures of the drive section 200, as frequency increases, the amount of induced current that is generated increases, so that, in a high frequency region of the order of from 10 kHz to 100 kHz, a sufficient amount of induced current is generated in accordance with frequency.

In contrast, in an ordinary voice coil having the characteristic L3, as frequency decreases, the amount of induced current increases. Therefore, in the high frequency region, a sufficient amount of induced current is not generated. This is because, at the high frequency region, the inductance component increases.

According to the structures of the drive section 200 of the embodiment, a sufficient amount of induced current is generated in the high frequency region, so that, even if the voltage is low, it is possible to efficiently generate an electromagnetic force at the cylindrical conductive member 230.

In the liquid drop discharger 1 of the embodiment, the primary coil 210 of the drive section 200 has two coiled portions one above the other, and the cylindrical conductive member 230, serving as a secondary coil, is disposed between the two coiled portions. Therefore, as shown in FIG. 8, even in the high frequency region of the order of 100 kHz, a sufficient amount of induced current is generated without being affected by inductance. This means that, even in a higher frequency operation region, it is possible to drive the cylindrical conductive member 230 at a sufficiently low voltage. Accordingly, the discharger 1 can be suitable for use.

The liquid drop discharger 1 having the aforementioned structures can be driven at a very high frequency. This is described with reference to FIG. 9.

Figure 9A:
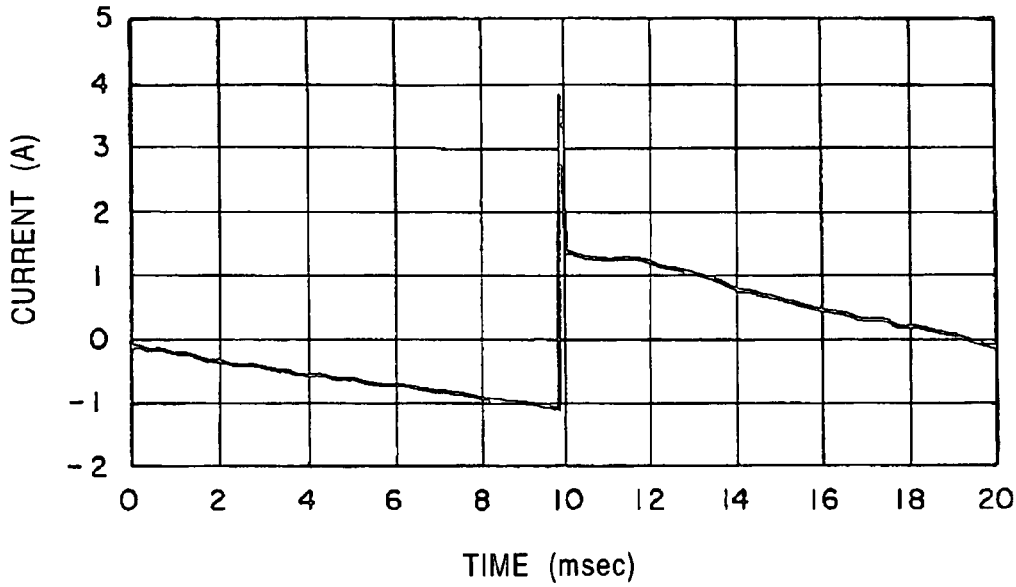
FIG. 9A is a graph showing a waveform of electrical current applied to the primary coil when discharging a liquid drop in the liquid drop discharge head of the first embodiment of the present invention.
Figure 9B:
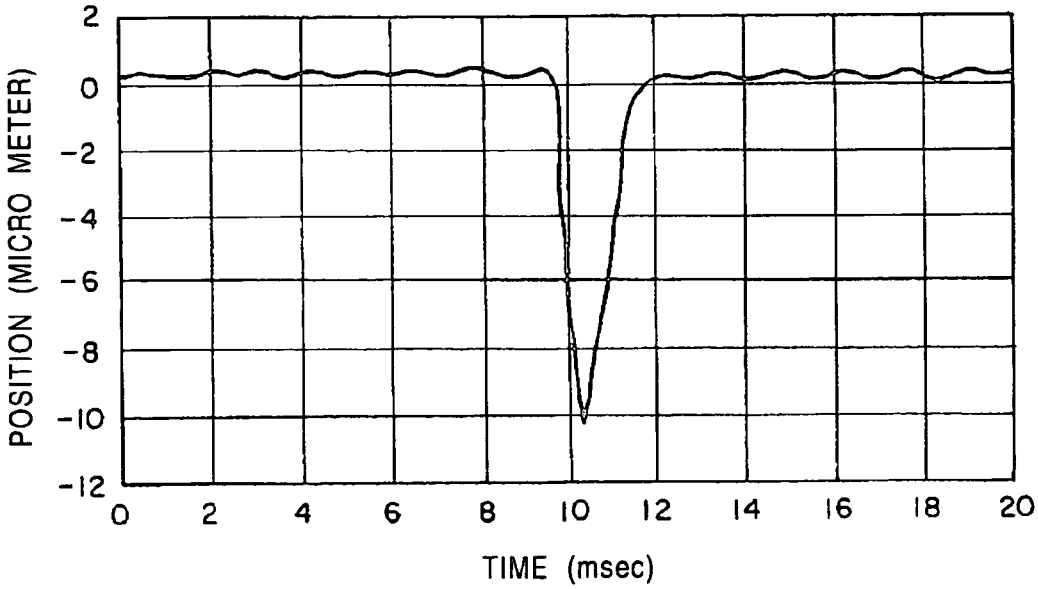
FIG. 9B is a graph illustrating a state in which a liquid chamber is expanded and contracted, based on the applied electrical current illustrated in FIG. 9A.

FIG. 9A is a graph of the waveform of an electric current introduced into the primary coil 210 when the liquid drop discharger 1 periodically discharges an equal amount of liquid drops at a frequency of 50 Hz. The horizontal axis represents time, and the vertical axis represents current. FIG. 9B is a graph illustrating the contracted state of the liquid chamber 130 when a signal that is shown in FIG. 9A is input. The horizontal axis represents time, and the vertical axis represents position. The graph of FIG. 9B illustrates changes in the position of the discharge opening 123 in the central axial direction of the primary coil 210, with the positive region representing a change in position in the direction of expansion and the negative region representing a change in position in the direction of contraction.

As shown in FIG. 9, the amount of time that elapses from the time current is introduced into the primary coil 210 to the time the discharge opening 123 (front surface 122) moves is approximately 0.5 ms. This amount of time can be considered as corresponding to the response speed measured from the time of application of a signal to the time of liquid discharge. It can be seen that the response speed is very high.

Therefore, if the liquid drop discharger 1 is used, liquid drops can be discharged at a high speed by proper response to a high-frequency drive signal. More specifically, the liquid drop discharger 1 may be suitably used for, for example, precisely discharging a liquid dropwise onto a predetermined specified location of, for example, a disc rotating at a high speed.

A related piezo liquid drop discharging mechanism discharges liquid drops by compressing a liquid chamber 130, whereas the liquid drop discharger 1 of the embodiment can discharge liquid drops by moving the front surface 122 in the directions in which the liquid chamber 130 expands and contracts. Therefore, the liquid drop discharger 1 can properly discharge liquid in accordance with, for example, the type of liquid to be discharged and the discharge condition, so that it can be used in a wider range of objectives, devices, and applications.

The structure of the liquid drop discharger of the present invention is not limited to that of the liquid drop discharger 1 of the embodiment, so that other specific structures, etc., may be used.

In the liquid drop discharger 1 of the embodiment, the moving section 140, which comprises the liquid discharge section 120 and the cylindrical conductive member 230 formed into an integral structure, can be easily separated from the nozzle 100. However, for example, the liquid chamber securing section 110 or the structural portions of, for example, the liquid chamber securing section 110 for handling liquid, such as the liquid reservoir 114, the liquid supplying path 113, and the back surface 111 of the liquid chamber securing section 110, may also be formed so as to be easily separable. Alternatively, the nozzle, itself, including the moving section 140 may be formed so as to be easily separable.

Since, like the moving section 140, these structural portions are not provided with an electrical wiring, they can be relatively easily removably formed as long as they can precisely return to their original positions. When the structural portions are formed in this manner, the structural portions, with which the liquid to be discharged contacts, including the liquid discharge section 120 are all removably formed. Therefore, the liquid drop discharger 1 is more suitable for use in applications that require frequent replacement of the liquid to be discharged and cleaning of the liquid chamber.

Although, in the nozzle 100 in the embodiment, the liquid reservoir 114 is disposed in the liquid chamber securing section 110, the liquid reservoir 114 does not necessarily have to be disposed. For example, if one wants to process a plurality of liquids, it is effective to dispose the liquid reservoir 114 for temporarily holding the liquids. On the other hand, if, for example, the nozzle 100 is used in a printer device to discharge ink, it is effective to directly supply the ink to the liquid chamber 130 from, for example, an ink bottle. Therefore, the liquid reservoir 114 is not required in such a case. The structure of the liquid drop discharger 1 of the present invention may be changed when necessary in accordance with the purpose of use.

Although the embodiment is described by taking as an example the liquid discharge head 10 having a basic structure including one nozzle 100 and one drive section 200, liquid drop dischargers comprising nozzles 100 and drive sections 200 may be used.

Figure 10:
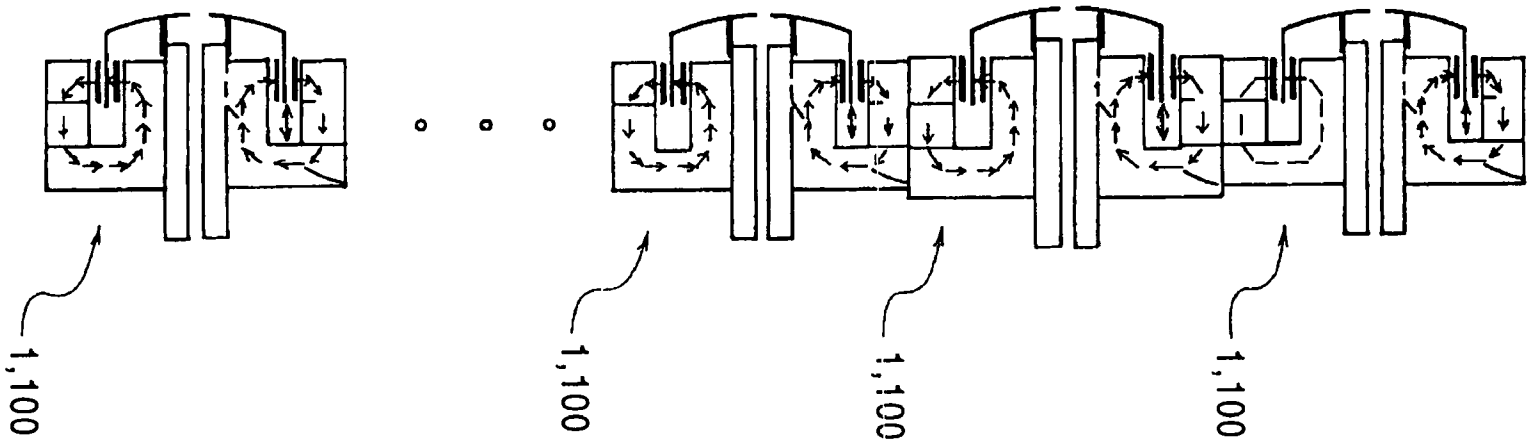
FIG. 10 shows a first example of another structure of the liquid drop discharge head of the present invention.

More specifically, as shown in FIG. 10, a plurality of the liquid drop dischargers 1 of the embodiment may be disposed along a straight line so that they can discharge liquid drops at the same time or separately. This structure is effective when, for example, using the liquid drop dischargers 1 of the present invention as line heads of a printer device. In this case, the same liquid or different liquids may be discharged from respective liquid drop discharge heads 10.

When one liquid drop discharger is formed by integrating a plurality of nozzles 100, the form of integration and connection of the nozzles 100 is not limited to a linear form shown in FIG. 10; so that they may be integrated in any form including a two dimensional integration.

Figure 11:
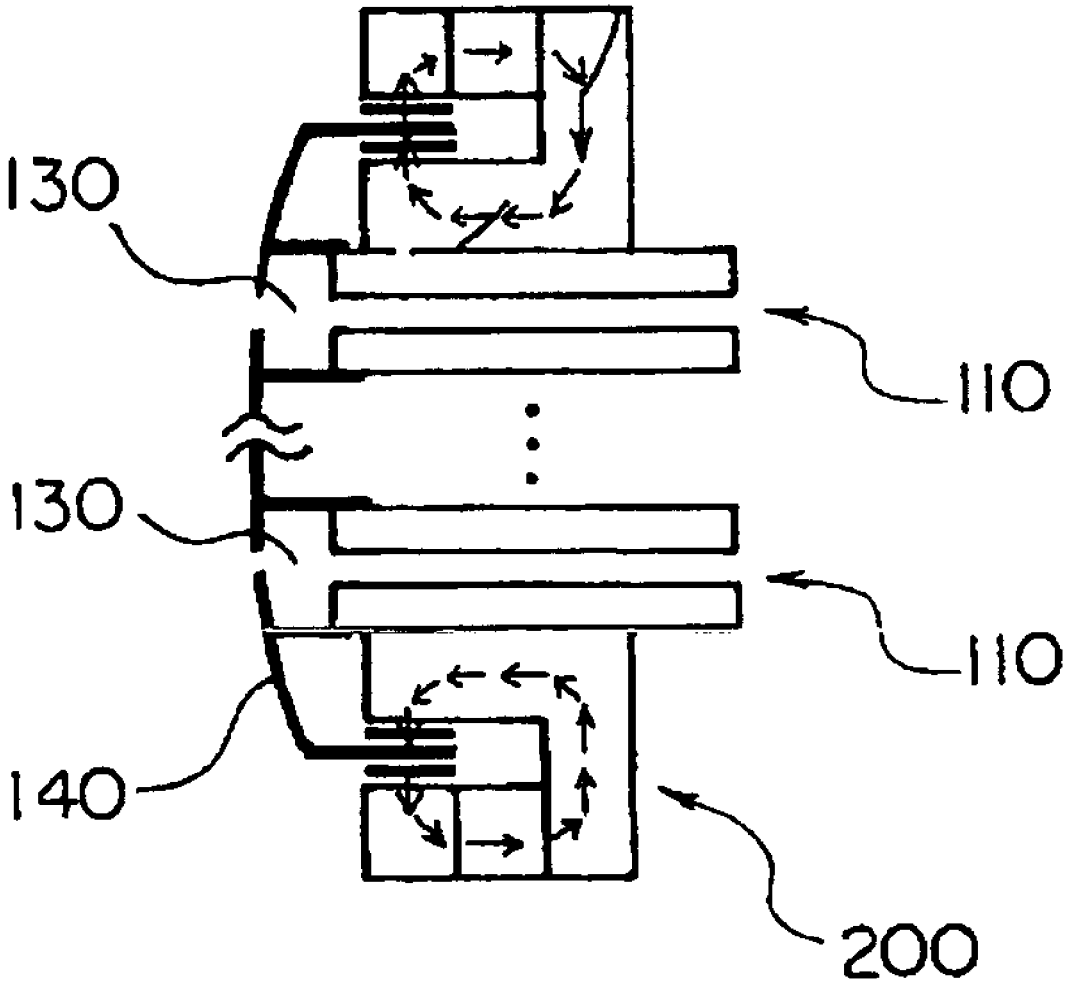
FIG. 11 shows a second example of another structure of the liquid drop discharge head of the present invention.

For example, as shown in FIG. 11, a plurality of liquid chamber securing sections 110, liquid chambers 130, and discharge openings 123 may be disposed with respect to one drive section 200 and one moving section 140. By virtue of such a structure, it is possible to discharge a plurality of liquids at the same time by driving one drive section 200.

In this case, the same type of liquid or different types of liquid may be discharged from each discharge opening 123.

Although, in the embodiment, the moving section 140 is mounted to the nozzle 100 by fittingly mounting the guide 124 to the liquid chamber securing section 110, other auxiliary supporting means may be used. For example, in order to prevent a large amount of liquid from being discharged as a result of the liquid chamber 130 contracting more than is necessary due to, for example, malfunctioning of the drive section 200, a resilient member, such as a spring or a rubber, may be disposed at a side where the movement of the cylindrical conductive member 230 is to be limited so that the range of movement of the cylindrical conductive member 230 in a direction opposite to the front plate 121, that is, in the direction in which the liquid chamber 130 contracts is limited.

In the embodiment, the cylindrical conductive member 230 is disposed between the outer primary coil 211 and the inner primary coil 212 of the primary coil 210. The cylindrical conductive member 230 may be disposed anywhere as long as it is disposed at least within a range in which the magnetic field that is generated by the primary coil 210 can act upon the cylindrical conductive member 230.

The form of electrical connection of the outer primary coil 211 and the inner primary coil 212 of the primary coil 210 may be a parallel connection or a series connection. If the winding direction of the coils (direction of flow of current) is the same, any form of connection may be used.

Although, in the embodiment, the primary coil 210 has two coiled portions one above the other, it may have one coiled portion. As described above with reference to FIG. 8, it is sufficiently effective to use the primary coil 210 when it has one coiled portion as compared to a related voice coil.

In this case, the primary coil 210 and the cylindrical conductive member 230, serving as a secondary coil, may be arbitrarily disposed. For example, the cylindrical conductive member 230 may be disposed at the outer side of the primary coil 210, or the primary coil 210 may be disposed at the outer side of the cylindrical conductive member 230.

Although, in the embodiment, the coil that moves the moving section 140 by being subjected to an electromagnetic force is a cylindrical or annular conductive member, the coil may be an ordinary coil having wound conductive wires.

The material, dimensions, form, etc., of each of the structural parts of the liquid drop discharger 1 of the embodiment are not limited to those mentioned above, so that they may be arbitrarily changed.

Although, in the embodiment, the cylindrical conductive member 230 is a ring formed of aluminum, it may be formed of any nonmagnetic conductive material. The cylindrical conductive member 230 may be formed of any conductive material other than a ferromagnetic material.

Second Embodiment

A second embodiment of the present invention will be described with reference to FIG. 12.

The second embodiment of the present invention is described by taking as an example a DNA disc player for analyzing DNA using a reaction such as hybridization.

In the DNA disc player of the embodiment, probe DNAs containing detection substances are disposed on a disc, and a solution containing a target material and a fluorescent marker agent and serving as a test specimen is discharged dropwise onto the probe DNAs, so that a reaction, such as hybridization, occurs between the bases. By irradiating the resulting substance with pump light, fluorescent light from the fluorescent marker agent is detected in order to detect the bond strength between the bases and the base sequence of the DNAs, so that the target substance is analyzed.

Figure 12:
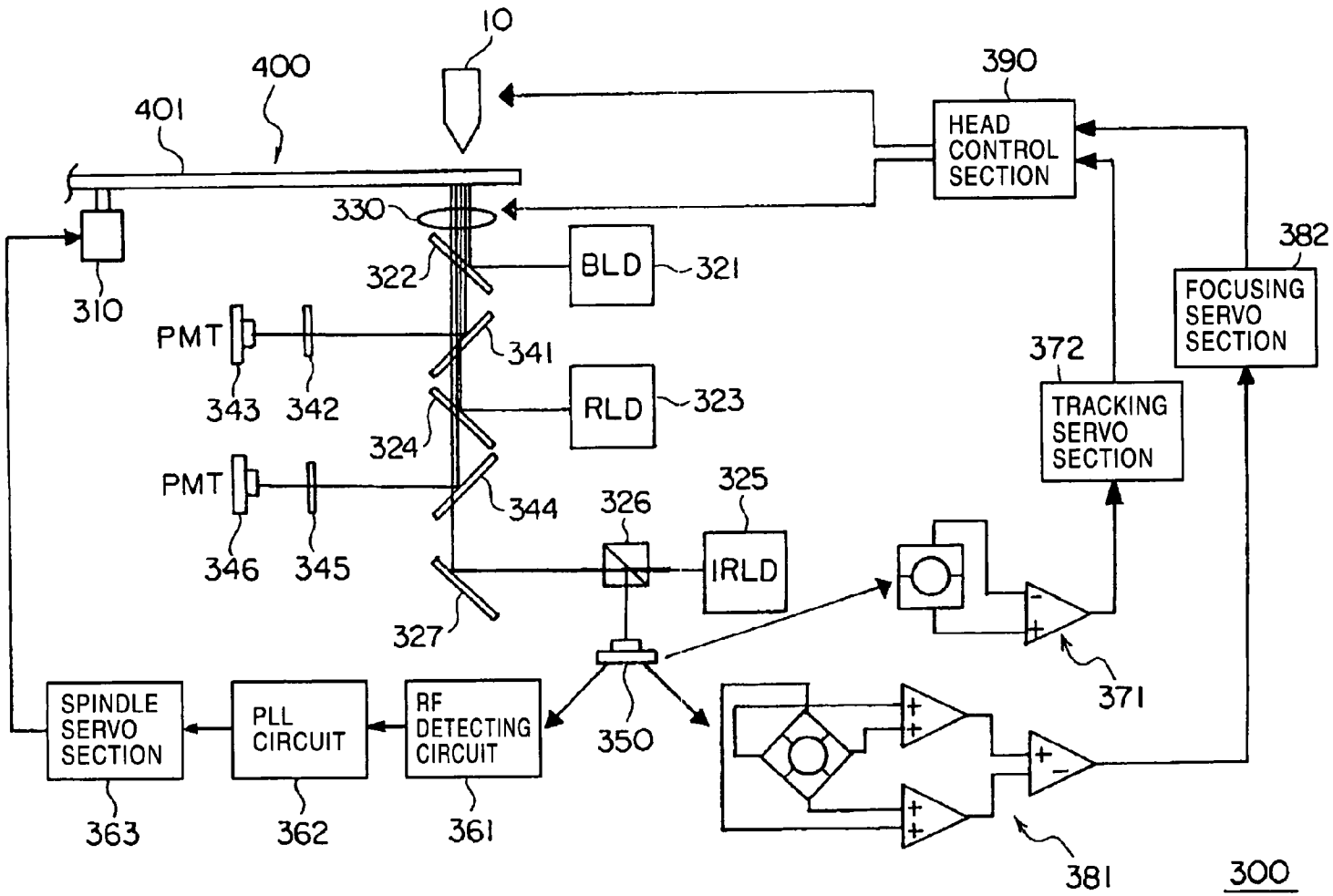
FIG. 12 illustrates the structure of a printer device of a second embodiment of the present invention.

FIG. 12 is a block diagram of the structure of a DNA disc player 300.

Hereunder, the structure and the operation of the DNA disc player 300 will be described with reference to FIG. 12.

A DNA disc 400 for performing, for example, hybridization is mounted to the DNA disc player 300. The disc 400 is a substrate formed of synthetic resin, such as polycarbonate or polystyrene, silicon, or quartz glass. A surface 401 has, for example, detection pits and address pits. The detection pits are provided for mutually reacting a detection substance and a target substance that are disposed on the pits. The address pits are used for specifying the positions on the disc 400.

The disc 400 is mounted to the DNA disc player 300 by mounting the disc 400 to a spindle of a disc supporting section (not shown), which is rotationally driven by a spindle motor 310.

The spindle motor 310 is rotationally driven based on a drive signal applied from a spindle servo section 363 in order to rotate the disc 400, which is mounted to the spindle. The DNA disc player 300 of the embodiment is a CAV device for rotating the disc 400 at a constant angular velocity. Therefore, the spindle motor 310 is rotationally driven at a constant velocity at all times.

The DNA disc player 300 comprises the liquid drop discharge head 10 used in the present invention.

The liquid drop discharge head 10 is controlled by a head control section 390 having the function of the aforementioned current control circuit 20, and discharges a liquid containing a detection substance or a liquid containing a target substance onto the detection pits in the front surface of the disc 400, mounted to the DNA disc player 300.

The liquid drop discharge head 10 is moved to a detection pit to which the liquid is discharged, that is, to a location on the disc 400 by driving an actuator (not shown) based on a controlling operation of the head control section 390.

The liquid to be discharged is supplied to the nozzle 100 when necessary from a liquid supplying section (not shown) through the air removing hole 117 of the cover 116 of the liquid drop discharge head 10 based again on the controlling operation of the head control section 390.

The actual timing of liquid discharge, the amount of liquid that is discharged, etc., are controlled by the head control section 390 by carrying out a controlling operation that is equivalent to the controlling operation of the current control circuit 20 of the liquid drop discharger 1, that is, by supplying a predetermined amount of current to the primary coil 210 of the liquid drop discharge head 10.

A blue laser diode (BLD) 321 is a semiconductor laser for emitting blue laser light, which is a first pump light of the fluorescent marker agent and has a wavelength of 405 nm. A light beam emitted from the BLD 321 is reflected by a dichroic mirror 322 in order to illuminate the disc 400 through an objective lens 330.

A red laser diode (RLD) 323 is a semiconductor laser for emitting red laser light, which is a second pump light of the fluorescent marker agent and has a wavelength of 640 nm. A light beam emitted from the RLD 323 is reflected by a dichroic mirror 324 in order to illuminate the disc 400 through the objective lens 330.

An infrared laser diode (IRLD) 325 is a semiconductor laser for emitting infrared laser light, which is a laser beam for performing a tracking servo operation and a focus servo operation and which has a wavelength of 780 nm. A light beam emitted from the IRLD 325 is reflected by a mirror 327 through a beam splitter 326 in order to illuminate the disc 400 through the objective lens 330.

The light beam emitted from the IRLD 325 passes through a diffraction grating (not shown) to generate a zeroth diffraction light and a ± first order diffraction light. The disc 400 is irradiated with the diffraction light.

The objective lens 330 is disposed at an optical head (not shown), and focuses incident light beams emitted from the BLD 321, RLD 323, and IRLD 325, so that a processing portion on the disc 400, that is, the place where the probe DNA is disposed, the place where the target substance is discharged dropwise, or the place where fluorescence from the fluorescent marker agent is detected, is irradiated with a predetermined very small spot light.

An actuator (not shown) moves the objective lens 330 in a tracking direction (radial direction of the disc 400) and a focusing direction (vertical direction with respect to the disc 400).

A portion of exited fluorescent light at the disc 400 is reflected by the dichroic mirror 341, and impinges upon a first electron multiplier (PMT) 343 through a filter 342 that only passes light having a wavelength of 480 nm. When the first electron multiplier (PMT) 343 detects the fluorescent light from the disc 400, the first electron multiplier (PMT) 343 outputs a detection signal to an analyzing host computer (not shown).

A portion of the exited fluorescent light at the disc 400 is reflected by the dichroic mirror 344, and impinges upon a second electron multiplier (PMT) 346 through a filter 345 that only passes light having a wavelength of 680 nm. When the second electron multiplier (PMT) 346 detects the fluorescent light from the disc 400, the second electron multiplier (PMT) 346 outputs a detection signal to the analyzing host computer (not shown).

A portion of the fluorescent light from the disc 400 transmitted through the dichroic mirror 344 is reflected by the mirror 327 and the beam splitter 326, and impinges upon a photodetector 350.

The photodetector 350 comprises a four-part split photodetector, each portion detecting a zeroth diffraction light emitted from, for example, the IRLD 325; and two photodetectors, which are disposed on respective sides of the photodetector 350 for detecting a ± first order diffraction light. Each photodetector generates a light detection signal in accordance with a corresponding detected light intensity. The light detection signals are output to a circuit of each of a spindle servo system, a tracking servo system, and a focus servo system.

In the spindle servo system, an RF signal detecting section 361 detects the frequency of the zeroth diffraction light detected by the photodetector 350. The detection result is input to a PLL circuit 362 in order to control the diffraction light so that it has a desired phase and frequency. Then, from a signal output from the PLL circuit 362, the spindle servo section 363 generates a drive signal for actually driving the spindle motor 310. The generated drive signal is applied to the spindle motor 310, thereby maintaining the rotation of the spindle motor 310 at a predetermined constant velocity.

In the tracking servo system, a computing circuit 371 compares, for example, at least the intensities of the reflected ± first order diffraction lights detected by the photodetector 350, and generates a tracking error signal based on the comparison. Then, based on the tracking error signal, a tracking servo section 372 generates a tracking servo signal, and the tracking servo signal is output to the head control section 390.

In the focus servo system, the computing circuit 381 adds the diagonal components of the light detection signals, detected from the respective detecting portions, of the zeroth diffraction lights, detected by the four-part split photodetector of the photodetector 350. Then, the computing circuit 381 detects the difference between the diagonal components to generate a focus error signal. Based on the focus error signal, a focus servo section 382 generates a focus servo signal, and the focus servo signal is output to the head control section 390.

Based on the tracking servo signal input from the tracking servo section 372, the focus servo signal input from the focus servo section 382, and operation control signals from a controlling computer and an analyzing computer (neither of which is shown), the head control section 390 controls the liquid drop discharge head 10 and the optical head, that is, the objective lens 330, so that the liquid drop discharge head 10 and the optical head are in synchronism with each other and carry out a desired processing on the same location of the disc 400.

More specifically, the head control section 390 controls an actuator for moving the liquid drop discharge head 10 up to a discharge position and supplying a discharge liquid containing a detection substance or a discharge liquid containing a target substance to the liquid drop discharge head 10. The head control section 390 also, for example, applies a current to the primary coil 210 of the drive section 200 so that a desired amount of liquid is properly discharged dropwise onto the detection pits of the disc 400 at a desired timing.

The head control section 390 drives the actuator so that tracking and focusing are properly performed on the optical head (not shown) including the objective lens 330.

When DNA is analyzed with the DNA disc player 300 having such a structure, first; while rotating the disc 400, the liquid drop discharge head 10 discharges a solution containing a detection substance dropwise onto a predetermined location of the disc 400, that is, a detection pit. After discharging the solution dropwise, the solution is solidified on the disc 400 in order to form a detection disc. Examples of detection substances are a nucleotide chain, heptide, protein, fat, a low molecular compound, ribosome, and other biological substances.

Next, while rotating the disc 400, the liquid drop discharge head 10 discharges dropwise a solution containing a target substance (such as mRNA taken from, for example, a cell or a tissue) and a fluorescent marker agent onto the probe DNA.

Then, the disc 400 in this state is, for example, heated for a few hours in a constant temperature bath in order to mutually react the detection substance and the target substance.

After the passage of a predetermined amount of time, a portion of the target substance that was not involved in the mutual reaction is washed away, and the disc 400 is mounted to the DNA disc player 300 again. Then, while rotating the disc 400, any portion of the target substance that was involved in the mutual reaction is irradiated with the pump light from the BLD 321 and the RLD 323. Then, the first electron multiplier (PMT) 343 and the second multiplier (PMT) 346 detect the fluorescent light from the fluorescent marker agent.

By analyzing the detected fluorescence intensity and the bonding strength between the detection substance and the target substance, the target substance is practically analyzed.

According to the DNA disc player 300 having such a structure, by using the liquid drop discharge head 10, a desired amount of a desired liquid can be discharged dropwise precisely at a high speed upon a desired pit of the disc 400.

As a result, it is possible to analyze the target substance at a high speed in a short time. This means that it is possible to analyze a large quantity of the target substance at a very low cost. As a result, since a large number of the target substances can be analyzed at a high speed, the result of the analysis can be statistically processed, so that organic substances and biological substances, such as DNA, can be analyzed with high precision.

Since the moving section 140 and the liquid chamber 130 are easily cleaned and replaced, when the liquid drop discharge head 10 handles a large number of detection substances and a large number of target substances, it is possible to considerably reduce the trouble of cleaning and replacing the nozzle 100, so that the substances are efficiently analyzed.

Since the nozzle 100 is easily cleaned and replaced, analysis can be carried out with greater precision.

Since the liquid drop discharge head 10 can be provided at a low cost using a simple structure, the DNA disc player 300 can be provided at a low cost.

Since the liquid drop discharge head 10 is drivable at a low voltage and a high frequency, a liquid can be discharged dropwise at a greater speed, that is, a substance can be analyzed at a greater speed by, for example, rotating the disc 400 at a greater speed.

The structure of the DNA disc player 300 of the embodiment is not limited to that described above, so that the structure may be modified when necessary.

For example, although the DNA disc player 300 of the embodiment is described as having the structure shown in FIG. 1 comprising only one nozzle 100, the DNA disc player 300 may comprise liquid drop discharge heads 10 including liquid discharge openings, as shown in FIGS. 10 and 11.

In the case where, like the DNA disc player 300, a structure discharges a plurality of liquid drops of a plurality of types, if the structure comprises a plurality of nozzles 100 so that it can discharge a plurality of liquid drops at the same time or liquids of different types at the same time, analysis of a substance can be carried out more efficiently. No problems arise even if the DNA disc player 300 has such a structure, so that it is apparent that the DNA disc player 300 having this structure falls within the scope of the present invention.

The method and structure for performing a spindle servo operation, a tracking servo operation, and a focus servo operation of the DNA disc player 300 are not limited to those of the embodiment, so that other types of such method and structure may be used.

Although the DNA disc player 300 of the embodiment is described as being a CAV device for controlling the rotation of the disc 400 at a constant angular velocity, the DNA disc player 300 may be a CLV device for driving the disc 400 at a constant linear speed, or a device which is a CAV type or a CLV type depending upon zones of a disc.

Third Embodiment

A description of a printer device of a third embodiment of the present invention will be given with reference to FIG. 13.

Since an inkjet head used in the printer device of the embodiment corresponds, as described below, to the liquid drop discharger 1 of the first embodiment of the present invention, the same drawings illustrating the first embodiment and the same reference numerals will be used when describing the inkjet head.

Figure 13:
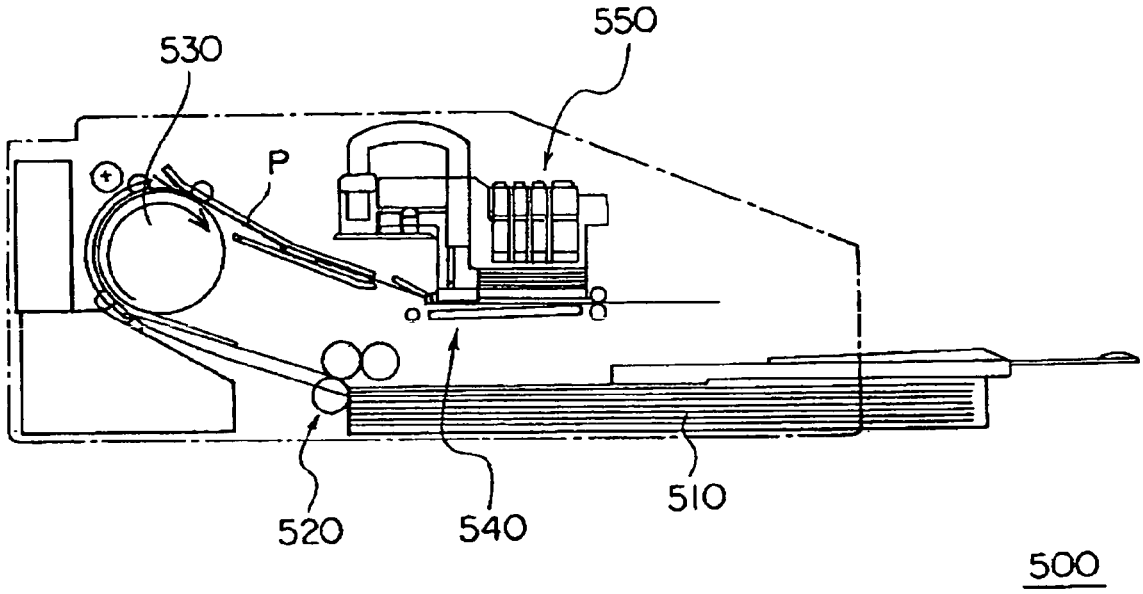
FIG. 13 illustrates the structure of a DNA disc player of a third embodiment of the present invention.

FIG. 13 is a schematic view of the structure of the printer device of the embodiment.

In a printer device 500, print sheets, which are print media, held by a paper tray 510, are transported to a location below an inkjet head section 550 through a reversal roller 530 and a sheet transport guide 540.

The inkjet head section 550 comprises four line heads in correspondence with ink colors, cyan, magenta, yellow, and black. The line heads correspond to a plurality of the liquid drop discharge heads 10 of liquid drop discharge devices 1 of the present invention, the heads 10 being disposed in a line. The ink discharge surface of each nozzle 100 extends downward in the direction of gravitational force, and is disposed so that it opposes the print sheets that are transported.

Each line head is supplied with ink of its corresponding color when necessary from an ink bottle.

Using the inkjet head section 550, a desired character, a figure, a symbol, an image, or the like, is printed onto a print sheet that is transported. After the printing, the print sheet is discharged.

In this way, the liquid drop discharger 1 of the present invention may also be used in the printer device 500 by using the liquid drop discharger 1 as an inkjet head for discharging liquid.

Since each nozzle 100 is easily cleaned and replaced, the printer device 500 can be easily maintained, so that the printer device 500 can perform high-quality printing. Since it is possible to drive the inkjet head at a low voltage and a high frequency, it is possible to provide a printer device having a high printing speed and low power consumption. Since there is no electrical contact with respect to a movable section at the head section and the head section has a simple structure, it is possible to provide a highly reliable, low-cost printer device.

Although, in the embodiment, the liquid drop discharge heads 10 are applied to line heads for performing color printing, a liquid drop discharge head 10 may also be used in, for example, a printer device in which a head moves over a print sheet and performs a printing operation on the print sheet. In addition, liquid drop discharge heads 10 may similarly be used as heads in which a relatively small number of nozzles 100 are disposed in a pulse arrangement either one-dimensionally or two-dimensionally. Further, a liquid drop discharge head 10 may similarly be used in a printer device for performing monochromatic printing.

Fourth Embodiment

A method of producing an organic EL panel of a fourth embodiment of the present invention will be described with reference to FIG. 14.

Figure 14:
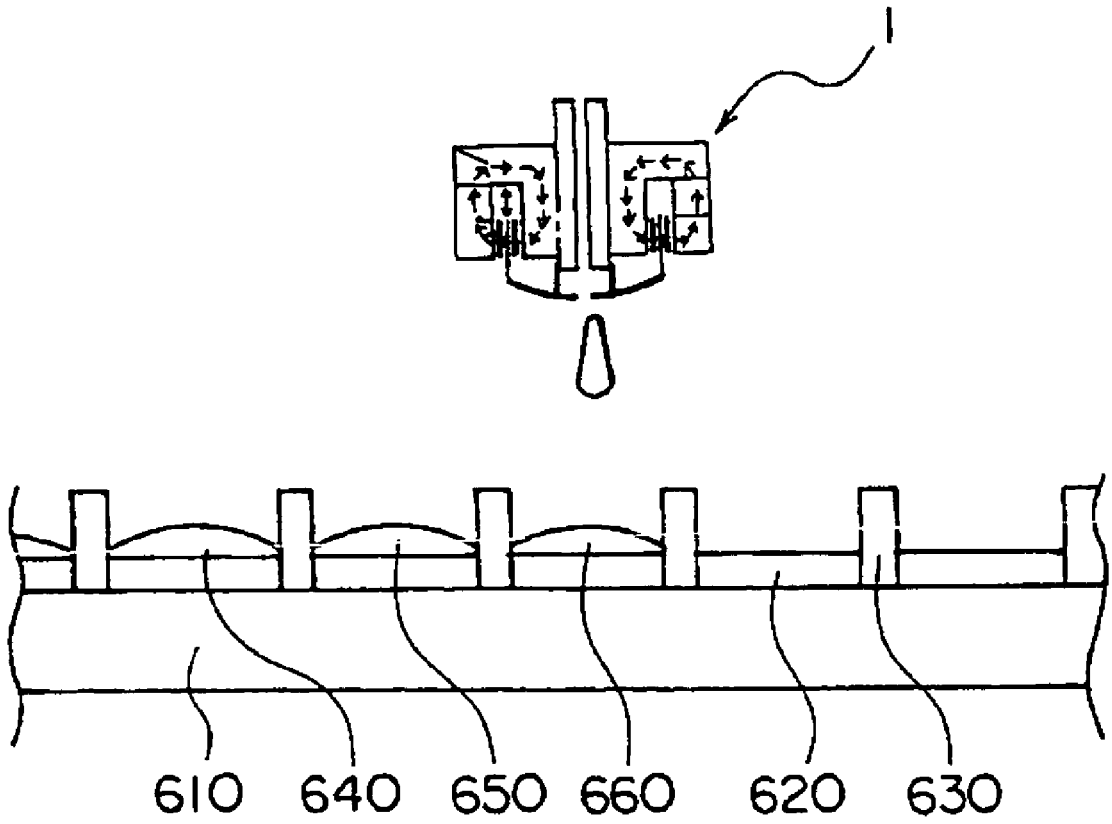
FIG. 14 illustrates a method of producing a display panel of a fourth embodiment of the present invention.

FIG. 14 illustrates a step of a process of producing an organic EL panel.

In producing the organic EL panel, first, an ITO transparent electrode 101 is formed at every pixel on a glass substrate 610 by photolithography.

Next, resins 630 are formed in the form of walls between the ITO transparent electrodes 101. The resins 630 prevent leakage of light between the pixels, prevent leakage of liquid, used to form a light-emitting layer, and segment the pixels.

The liquid drop discharger 1 of the first embodiment of the present invention discharges dropwise liquid light-emitting materials 640 to 660 onto areas of the respective pixels, which are segmented by the resins 630. The light-emitting materials 640 to 660 emit red light, green light, and blue light, respectively.

After discharging the light-emitting materials 640 to 660 dropwise, the light-emitting materials 640 to 660 are heated, thereby forming light-emitting layers.

Next, by discharging dropwise hole injection layer forming materials, such as polyvinylcarbazole (PKV), by similarly using the liquid drop discharger 1, the hole injection layer forming materials are driven into predetermined locations of the ITO transparent electrodes 101, thereby forming hole injection layers.

Lastly, reflection pixel electrodes (not shown) are formed on the hole injection layers in order to form a full-color organic EL panel.

Conventionally, it has been difficult to perform patterning of organic dyes, which emit three primary colors, blue, green, and red, in correspondence with pixels, and to dispose the patterned organic dyes because these materials cannot withstand a conventional patterning process, such as photolithography, due to the problem of its resistance to, for example, heat.

However, if, as in this embodiment, the liquid drop discharger 1 of the present invention is used, an exact desired amount of the materials can be precisely disposed at desired locations without heating the materials. In other words, it is possible to very finely dispose the light-emitting materials in correspondence with the panel pixels, so that the light-emitting layers may be formed by patterning using organic materials.

As mentioned above, since a nozzle 100 is easily cleaned and replaced, the liquid drop discharger 1 can discharge dropwise various materials in a high-quality state, so that a high-quality panel can be produced. Since, in addition to being possible to drive the inkjet head at a high frequency, a large number of man-hours is not required to maintain (for example, clean) the inkjet head, a panel can be produced in a short period of time at a high speed.

Although, in the embodiment, the process of producing an organic EL panel is described, the embodiment may be applied to producing other types of panels and displays when, for example, disposing materials in correspondence with pixels or when forming layers by patterning using predetermined materials.

For example, when producing a field emission display (FED), the embodiment may be applied to forming a field emission cathode (micro-cathode) at every pixel. By dispersing, for example, carbon nanotube in a solvent and applying the resulting liquid dropwise successively to the pixels using the liquid drop discharger 1, it is possible to form a cathode at each pixel.

Although it is desirable to form the FED micro-cathodes into the shape of very small needles so that they can easily discharge electricity, it is difficult to form such FED micro-cathodes by lithography. Therefore, an ordinary complicated process needs to be carried out. However, if the liquid drop discharger 1 is used to discharge liquids, used to form the electrodes, the liquid drop discharger 1 is effective in easily forming the electrodes.

Fifth Embodiment

A method of forming a conductive pattern on a substrate of a fifth embodiment of the present invention will be given with reference to FIG. 15.

Figure 15:
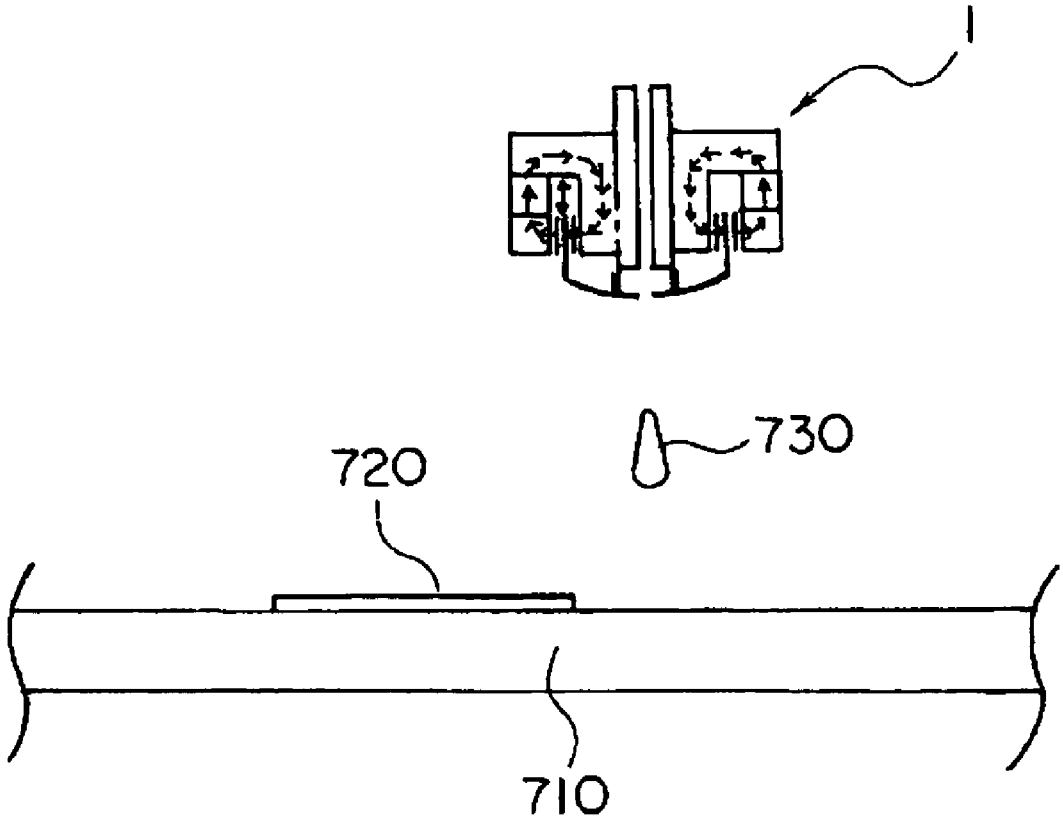
FIG. 15 illustrates a method of forming a conductive pattern of a fifth embodiment of the present invention

FIG. 15 illustrates a process of forming a conductive pattern.

When forming the conductive pattern, a liquid 730 containing fine metallic particles (for example, nano-order, fine particles) is supplied to the liquid drop discharger 1, which is drivably held by driving means (not shown), and the supplied liquid 730 is disposed on a substrate 710, which is held horizontally by a predetermined holder).

While discharging the liquid 730 containing the fine metallic particles by moving the liquid drop discharger 1 to a location where the conductive pattern is formed, the liquid drop discharger 1 is moved following loci of the conductive pattern to be formed.

By continuously discharging the liquid dropwise in this way, the desired conductive pattern 720 is formed on the substrate 710.

By forming, for example, a wiring pattern or an electrode pattern on a substrate using the liquid drop discharger 1, it is possible to form, for example, a very fine conductive pattern on a substrate or the like precisely. Therefore, it is possible to efficiently mount a circuit on the substrate.

Since the conductive pattern can be formed directly on the substrate, the process of forming the conductive pattern is simplified, so that a desired substrate can be produced in a short delivery time, and, thus, the period of production of equipment, devices, etc., using the substrate can be reduced.

The liquid drop discharger 1 of the present invention may also be used in this way.

The above-described first to fifth embodiments are disclosed for the sake of easier understanding of the present invention, and do not limit the present invention in any way.

In this way, according to the present invention, it is possible to provide a liquid drop discharger and a method of discharging a liquid drop, which make it possible to easily replace and clean a nozzle (moving section) without exposing a liquid to high temperature and high pressure. The device can be driven at a low voltage and a high frequency, and the method allows driving at a low voltage and a high frequency.

It is possible to provide various devices and production methods which make it possible to produce and manufacture a desired product efficiently so that it is of high quality as a result of discharging desired liquid drops at a high speed and with high precision by using the liquid drop discharger or the method of discharging a liquid drop.

More specifically, it is possible to provide a printer device and printing method, a test disc processor and a method of processing a test disc, a method of producing an organic EL panel, a method of forming a conductive pattern, and a method of producing a field emission display.

What is claimed is:

1. A liquid drop discharger comprising:

a coil for generating a magnetic field based on an electric current that is applied;

a moving section, removably disposed with respect to the coil so as to be movable in a central axial direction of the coil, for generating an induced current around the moving section by the magnetic field generated by the coil;

means for vertically applying a magnetic field to a peripheral surface of a peripheral member of the moving section; and a discharge opening, which moves together with the moving section, for discharging a liquid by changing the volume of a liquid chamber containing the liquid as a result of the movement of the moving section.

2. A liquid drop discharger according to claim 1, wherein the coil has two concentric coiled portions of different winding diameters, the winding directions of the coiled portions being the same.

3. A liquid drop discharger according to claim 1, wherein the moving section is removably disposed with respect to a flow path defining a portion of the liquid chamber containing the liquid.

4. A liquid drop discharger according to claim 1, wherein the flow path, which defines a portion of the liquid chamber, is removable from the coil and the magnetic field applying means.

5. A liquid drop discharger according to claim 1, wherein the moving section comprises a guide for allowing the movement of the moving section with respect to the flow path defining a portion of the liquid chamber containing the liquid.

6. A liquid drop discharger according to claim 1, wherein the moving section discharges the liquid by reciprocating between a predetermined reference position and a contraction position situated in a direction in which the volume of the liquid chamber is reduced from the reference position.

7. A liquid drop discharger according to claim 1, wherein the moving section discharges the liquid by reciprocating between a predetermined reference position and an expansion position situated in a direction in which the volume of the liquid chamber is increased from the reference position.

8. A liquid drop discharger according to claim 1, wherein the magnetic field applying means is an annular magnetic circuit having a gap in a portion thereof and being disposed so that the magnetic field is applied to the peripheral member with the coil and the peripheral member being disposed in the gap.

9. A liquid drop discharger according to claim 1, wherein the moving section has a plurality of the discharge openings for discharging liquid drops by the movement of the moving section.

10. A liquid drop discharger according to claim 1, further comprising a plurality of liquid drop discharge head sections each comprising at least the coil and the moving section.

11. A liquid drop discharger according to claim 1, comprising a plurality of the liquid chambers, wherein the same liquid or different liquids are supplied to the liquid chambers.

12. A liquid drop discharger according to claim 1, wherein the liquid from the discharge opening is any one of ink, a liquid containing a biological substance, a liquid containing an organic electroluminescent material, a liquid containing fine metallic particles, and a liquid dispersedly mixed with carbon nanotube.

13. A method of discharging a liquid drop, comprising the steps of:

applying a magnetic field vertically to a peripheral surface of a peripheral member of a moving section removably disposed with respect to a coil so as to be movable in a central axial direction of the coil;

generating a magnetic field by applying a predetermined electric current to the coil;

generating an induced current around the peripheral member by applying the magnetic field generated by the coil to the peripheral member;

moving the moving section by an electromagnetic force based on the applied magnetic field and the generated induced current; and discharging a liquid from a discharge opening by changing the volume of a liquid chamber containing the liquid by moving the moving section.

14. A method of discharging a liquid drop according to claim 13, wherein the liquid is discharged by moving the moving section so that the volume of the liquid chamber is reduced.

15. A method of discharging a liquid drop according to claim 13, wherein the liquid is discharged by moving the moving section so that the volume of the liquid chamber is increased.

16. A method of discharging a liquid drop according to claim 13, wherein the moving section has a plurality of the discharge openings for discharging a plurality of the liquid drops by moving the removing section.

17. A method of discharging a liquid drop according to claim 13, wherein the same liquid or different liquids are supplied to a plurality of the liquid chambers in order to discharge a plurality of the liquid drops at the same time.

18. A method of discharging a liquid drop according to claim 13, wherein the liquid to be discharged is any one of ink, a liquid containing a biological substance, a liquid containing an organic electroluminescent material, a liquid containing fine metallic particles, and a liquid dispersedly mixed with carbon nanotube.

19. A test chip processor comprising:

a chip drive section for holding a test chip and moving the test chip under a predetermined condition;

a liquid drop discharge head section for discharging a liquid to be tested dropwise onto predetermined locations of the test chip; and a sensor for performing testing by irradiating the predetermined locations of the test chip with light, wherein the liquid drop discharge head section comprises:

a coil for generating a magnetic field based on an electric current that Is applied;

a moving section, removably disposed with respect to the coil so as to be movable in a central axial direction of the coil, for generating an induced current around the moving section by the magnetic field generated by the coil;

means for vertically applying a magnetic field to a peripheral surface of a peripheral member of the moving section; and a discharge opening, which moves together with the moving section, for discharging the liquid by changing the volume of a liquid chamber containing the liquid as a result of the movement of the moving section.

20. A test chip processor according to claim 19, wherein the test chip is a DNA chip having probe DNAs disposed in a predetermined arrangement, wherein the predetermined locations of the test chip correspond to the locations of the probe DNAs on the DNA chip, and wherein a state of a bonding reaction of a nucleic acid to be tested in the probe DNA is tested.

21. A test chip processor according to claim 19, wherein the test chip is a test disc, and wherein the chip drive section holds the test disc and rotates the test disc under the desired condition.

22. A method of processing a test chip, comprising the step of:

performing testing by discharging a liquid to be tested dropwise onto a predetermined location of the test chip and irradiating with light the predetermined location, wherein the dropwise discharge of the liquid comprises the steps of:

applying a magnetic field vertically to a peripheral surface of a peripheral member of a moving section removably disposed with respect to a coil so as to be movable in a central axial direction of the coil;

generating a magnetic field by applying a predetermined electric current to the coil;

generating an induced current around the peripheral member by applying the magnetic field generated by the coil to the peripheral member;

moving the moving section by an electromagnetic force based on the applied magnetic field and the generated induced current; and discharging the liquid from a discharge opening by changing the volume of a liquid chamber containing the liquid by moving the moving section.

23. A printer device comprising:

an ink discharge head comprising:

a coil for generating a magnetic field based on an electric current that is applied;

a moving section, removably disposed with respect to the coil so as to be movable in a central axial direction of the coil, for generating an induced current around the moving section by the magnetic field generated by the coil;

means for vertically applying a magnetic field to a peripheral surface of a peripheral member of the moving section; and a discharge opening, which moves together with the moving section, for discharging ink by changing the volume of a liquid chamber containing the ink as a result of the movement of the moving section.

24. A printing method comprising the steps of:

applying a magnetic field vertically to a peripheral surface of a peripheral member of a moving section removably disposed with respect to a coil so as to be movable in a central axial direction of the coil;

generating a magnetic field by applying a predetermined electric current to the coil;

generating an induced current around the peripheral member by applying the magnetic field generated by the coil to the peripheral member;

moving the moving section by an electromagnetic force based on the applied magnetic field and the generated induced current; and discharging ink from a discharge opening by changing the volume of a liquid chamber containing the ink by moving the moving section, so that a desired printing operation is performed.

25. A method of producing an organic electroluminescent panel comprising a light-emitting layer on a substrate, the method comprising the step of:

forming the light-emitting layer by discharging a liquid containing a light-emitting material dropwise onto and applying the liquid to a predetermined location by a liquid discharge head, wherein the dropwise discharge of the liquid by the liquid discharge head comprises the steps of:

applying a magnetic field vertically to a peripheral surface of a peripheral member of a moving section removably disposed with respect to a coil so as to be movable in a central axial direction of the coil;

generating a magnetic field by applying a predetermined electric current to the coil;

generating an induced current around the peripheral member by applying the magnetic field generated by the coil to the peripheral member;

moving the moving section by an electromagnetic force based on the applied magnetic field and the generated induced current; and discharging the liquid from a discharge opening by changing the volume of a liquid chamber containing the liquid by moving the moving section.

26. A method of forming a conductive pattern, comprising the steps of:

applying a magnetic field vertically to a peripheral surface of a peripheral member of a moving section removably disposed with respect to a coil so as to be movable in a central axial direction of the coil;

generating a magnetic field by applying a predetermined electric current to the coil;

generating an induced current around the peripheral member by applying the magnetic field generated by the coil to the peripheral member;

moving the moving section by an electromagnetic force based on the applied magnetic field and the generated induced current; and discharging a liquid containing fine conductive particles from a discharge opening by changing the volume of a liquid chamber containing the liquid by moving the moving section, so that a desired conductive pattern is formed on a substrate.

27. A method of producing a field emission display, comprising the step of:

forming a field emission cathode by successively discharging dropwise a liquid dispersedly mixed with a carbon nanotube onto and applying the liquid to a predetermined location by a liquid discharge head, wherein the dropwise discharge of the liquid by the liquid discharge head comprises the steps of:

applying a magnetic field vertically to a peripheral surface of a peripheral member of a moving section removably disposed with respect to a coil so as to be movable in a central axial direction of the coil;

generating a magnetic field by applying a predetermined electric current to the coil;

generating an induced current around the peripheral member by applying the magnetic field generated by the coil to the peripheral member;

moving the moving section by an electromagnetic force based on the applied magnetic field and the generated induced current; and discharging the liquid from a discharge opening by changing the volume of a liquid chamber containing the liquid by moving the moving section.

* * * * *